US006850216B2

(12) United States Patent
Akimoto et al.

(10) Patent No.: US 6,850,216 B2
(45) Date of Patent: Feb. 1, 2005

(54) IMAGE DISPLAY APPARATUS AND DRIVING METHOD THEREOF

(75) Inventors: Hajime Akimoto, Oume (JP); Minoru Hoshino, Hitachi (JP); Yoshiro Mikami, Hitachiota (JP); Shinichi Komura, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 250 days.

(21) Appl. No.: 09/809,002

(22) Filed: Mar. 16, 2001

(65) Prior Publication Data

US 2002/0084967 A1 Jul. 4, 2002

(30) Foreign Application Priority Data

Jan. 4, 2001 (JP) ..... 2001-000048

(51) Int. Cl.[7] ..... G09G 3/36

(52) U.S. Cl. ..... 345/90; 345/92; 345/98; 345/547

(58) Field of Search ..... 345/204–214, 345/90, 92–100, 102, 104, 530, 536, 87, 547; 315/169.1–169.3; 313/463, 483; 349/45, 48, 51, 69, 151

(56) References Cited

U.S. PATENT DOCUMENTS

| | | | | | |
|---|---|---|---|---|---|
| 5,627,557 | A | * | 5/1997 | Yamaguchi et al. | 345/90 |
| 5,712,652 | A | * | 1/1998 | Sato et al. | 345/90 |
| 5,844,538 | A | * | 12/1998 | Shiraki et al. | 345/98 |
| 5,945,972 | A | * | 8/1999 | Okumura et al. | 345/98 |
| 6,115,017 | A | * | 9/2000 | Mikami et al. | 345/92 |
| 6,295,054 | B1 | * | 9/2001 | McKnight | 345/205 |
| 6,392,620 | B1 | * | 5/2002 | Mizutani et al. | 345/88 |
| 6,456,267 | B1 | * | 9/2002 | Sato et al. | 345/92 |

* cited by examiner

*Primary Examiner*—Henry N. Tran
(74) *Attorney, Agent, or Firm*—Antonelli, Terry, Stout & Kraus, LLP

(57) ABSTRACT

An image display apparatus has a display part composed of plural pixels; a control part for controlling the display part; and a signal line arranged inside the display part for inputting a display signal into the pixel. The pixel has at least one or more switches and first capacitances for storing the display signal input through the signal line as a charge for a designated period of time or longer. The pixel also operates to rewrite the display signal stored in the first capacitance into the first capacitance without using the signal line in response to an instruction of the control part.

42 Claims, 23 Drawing Sheets

Tf:1 FIELD PERIOD
T3:MSB(HERE,DEFINED AS THIRD BIT)DATA DISPLAY PERIOD
T2:DISPLAY PERIOD FOR SECOND BIT
T1:LSB(HIRE,DEFINED AS FIRST BIT)DATA DISPLAY PERIOD

IMAGE DISPLAY APPARATUS AND DRIVING METHOD THEREOF

BACKGROUND OF THE INVENTION

The present invention relates to an image display apparatus which is capable of producing an image display with lower electric power consumption.

FIGS. 27 and 28 illustrate two known image display apparatus. FIG. 27 shows an example of the configuration of a known TFT liquid crystal display panel. The pixels 210, each having liquid crystal capacitance 209, are arranged in a matrix configuration in the display portion of the panel (only a single pixel 210 is illustrated in FIG. 27 for simplifying the drawing). The pixel 210 is connected through the gate line 211 and the AC drive signal line 207 to the gate line drive circuit 215, and it is connected through the positive signal line 212 and the negative signal line 213 to the signal line drive circuit 214. The pixel 210 has a SRAM (Static Random Access Memory) composed of the inverter 203 and the inverter 204, and its two data input and output nodes are connected through the data input switches 201 and 202 to the positive signal line 212 and the negative signal line 213, respectively. Those data nodes are also connected to the liquid crystal capacitance write switches 205 and 206. The liquid crystal capacitance is connected through the liquid crystal capacitance write switches 205 and 206 to the AC drive signal line 207 and the reset voltage line 208.

Now, the operation in this pixel arrangement will be described. As the gate line drive circuit 215 opens and closes the data input switches 201 and 202 for the designated pixel line through the gate line 211, the 1-bit complementary image data on the positive signal line 212 and the negative signal line 213 supplied by the signal drive circuit 214 are put into the SRAM composed of the inverter 203 and the inverter 204 in the pixel 210. As long as the electric power is applied, the SRAM statically holds the 1-bit image data as supplied in the above manner. One of the liquid crystal capacitance write switches 205 and 206 is turned on by the image data written in the SRAM, so that, the voltage selected exclusively from either of the AC drive signal line 207 or the reset voltage line 208 is applied to the liquid crystal capacitance 209. Thus, if the AC drive signal line 207 is selected, AC voltage is applied to the liquid crystal capacitance 209, and if the reset voltage line 208 is selected, no voltage is applied to the liquid crystal capacitance 209. Owing to this operation, this liquid crystal display panel can continue to display the 1-bit display image even if the scan of the gate line 211 by the gate line drive circuit 215 and the data output to the positive signal line 212 and to the negative signal line 213 by the signal line drive circuit 214 are suspended.

The known display panel construction as described above is described in detail in Japanese Patent Application Laid-open No. 8-286170 (1996).

Next, referring to FIG. 28, another known pixel arrangement will be described. FIG. 28 shows an example of the configuration of the TFT liquid crystal display panel using a prior art. The pixels 230, each having liquid crystal capacitance, are arranged in a matrix configuration between the pixel electrodes 224 and the opposed electrodes 225 in the display portion of the panel (only a single pixel 230 is illustrated in FIG. 28 for simplifying the drawing). The pixel 230 is connected through the gate line 231 to the gate line drive circuit 235, and it is connected through the signal line 232 to the signal line drive circuit 234. The pixel 230 has a DRAM (Dynamic Random Access Memory) composed of the data input switch 221 and the hold capacitance 222, and the terminal of its data input switch 221 is connected to the signal line 232. The data node of the DRAM is connected to the gate of the pixel drive switch 223, and the liquid crystal capacitance is connected through the pixel drive switch 223 to the common electrode line 233. The common electrode line 233 is connected to the common electrode drive circuit 237, and the opposed electrode 225 is connected to the opposed electrode drive circuit 236.

Now the operation in this pixel arrangement will be described. As the gate line drive circuit 235 opens and closes the data input switch 221 for the designated pixel line through the gate line 231, the l-bit image data on the signal line 232 supplied by the signal line drive circuit 234 is put into the DRAM composed of the data input switch 221 and the hold capacitance 222. In response to the image data written into the DRAM, the pixel drive switch 223 is locked so as to hold an on state or an off state. As AC voltage is applied to the opposed electrode by the opposed electrode drive circuit 236 and a designated voltage is applied to the common electrode line 233 by the common electrode drive circuit 237, if the pixel drive switch 223 is turned on, AC voltage is applied to the liquid crystal capacitance between the pixel electrode 224 and the opposed electrode 225; and, in contrast, if the pixel drive switch 223 is turned off, no voltage is applied to the liquid crystal capacitance. Owing to this operation, the liquid crystal display panel can continue to display the 1-bit display image until the data in the DRAM is lost due to leakage current, even if the scan of the gate line 231 by the gate line drive circuit 235 and the data output onto the signal line 232 by the signal line drive circuit 234 are suspended. In order to hold the display image data statically, it is only required to rewrite the DRAM periodically by scanning the gate line 231 with the gate line drive circuit 235 and putting out the data onto the signal line with the signal line drive circuit 234.

The known display panel construction as described above is described in detail in Japanese Patent Application Laid-Open Number 9-258168 (1997).

According to the display panels described above, it will be appreciated that the scan of the gate line and the data output onto the signal line may be suspended or the number of those operations can be reduced, which leads to the reduction in the electric power consumption for TFT liquid crystal display panels. However, with these known display panels, it is difficult to achieve simultaneously the reduction in the electric power consumption and a reduction in the cost.

In the display panel in which an SRAM is installed inside the pixel, there is an advantageous aspect in that the operations for scanning the gate line and for data output to the signal line can be completely suspended and the electric power consumption can be reduced; however, but in contrast, there is a disadvantageous aspect in that the pixel structure becomes inevitably sophisticated as the number of transistors formed in the SRAM is larger. As the throughput of manufactured devices inevitably will be reduced for the sophisticated pixel structure, the price of the image display apparatus may increase.

In the display panel in which a DRAM is installed inside the pixel, there is an advantageous aspect in that the pixel structure can be simplified as the number of transistors formed in the DRAM is reduced and a reduction in the price of the image display apparatus may be expected due to an increase in the throughput of the manufactured devices. However, since the DRAM requires rewrite (refresh)

operations, the operations for scanning the gate line by the gate line drive circuit 235 and for data output onto the signal line by the signal line drive circuit 234 can not completely suspended. As for the data output onto the signal line, since it is required to supply the data onto the signal line having a relatively larger parasitic capacitance as many times as the number of pixels for writing the overall display, there still remains a problem in that a further reduction in the electric power consumption can not achieved easily. In addition, since it is required to reserve the display image data to be used for the rewrite operation at any other part, additional electric power consumption and cost may be inevitable.

And furthermore, though the known display panels described above assume that 1-bit display image data will be used for an individual pixel, it is expected that the handling of multi-bit display image data will be necessary, as well as achieving a reduction in the electric power consumption and a reduction in the cost of the manufactured device.

SUMMARY OF THE INVENTION

According to an embodiment of the present invention, the problem of reduction in the electric power consumption and a reduction in the cost of the manufactured devices can be solved by providing an image display apparatus comprising a display part composed of plural pixels; a control part for controlling the display part; and a signal line arranged inside the display part for inputting a display signal into the pixel, in which the pixel has at least one or more switches and first capacitances for storing the display signal input through the signal line as charge for a designated period of time or longer; and further comprising a means for rewriting the display signal stored in the first capacitance into the first capacitance without using the signal line in response to an instruction from the control part.

In addition to the above problem, the problem of displaying multi-bit display data can be solved by forming plural (n+1) or more capacitances inside the individual pixel for storing an n-bit display signal as a charge for a designated period of time.

It will be appreciated that further downsizing in the cost of the manufactured devices can be established by further simplifying the pixel structure by forming a charge transfer device (CTD) in the individual pixel.

The problem of the reduction in the electric power consumption and the reduction in the cost of the manufactured devices can be solved by providing an image display apparatus comprising a display part composed of plural pixels; a display signal processing part for storing a display signal supplied from outside and performing data processing for the display signal; a control part for controlling the display part and the display signal processing part; and a signal line arranged inside the display part for inputting a display signal into the pixel, in which the pixel has at least one or more switches and first capacitances for storing the display signal input through the signal line as a charge for a designated period of time; and further comprising a means for rewriting the display signal stored in the first capacitance into the first capacitance without using the signal line in response to an instruction from the control part.

The problem of the reduction in the electric power consumption and the reduction in the cost of the manufactured devices can be solved by providing an image display apparatus comprising a display part composed of plural pixels; a control part for controlling the display part; and a signal line arranged inside the display part for inputting a display signal into the pixel, in which the pixel has at least one or more switches and first capacitances for storing the display signal input through the signal line as a charge for a designated period of time or longer; and further comprising a drive method for rewriting the display signal stored in the first capacitance into the first capacitance without using the signal line in response to an instruction from the control part.

A drive method of an image display apparatus comprising a display part composed of plural pixels; a display signal processing part for storing a display signal supplied from outside and performing data processing for the display signal; a control part for controlling the display part and the display signal processing part; and a signal line arranged inside the display part for inputting a display signal into the pixel; in which the pixel has at least one or more switches and first capacitances for storing the display signal input through the signal line as a charge for a designated period of time, wherein the method comprises a first mode for rewriting the display signal stored in the first capacitance into the first capacitance without using the signal line in response to an instruction from the control part; and a second mode for writing a display signal having analog voltage or multi-valued voltage levels is performed by interrupting the rewrite operation for the first capacitance in the pixel and using a signal line to the first capacitance instead, in which the electric power consumption of a display signal processing part in the first mode is made smaller than the electric power consumption of a display signal processing part in the second mode.

BRIEF DESCRIPTION OF THE DRAWINGS

FIGS. 5(*d*) to 5(*g*) are diagrams of potential values at times (d)–(g), respectively, in FIG. 4 when writing 2-bit pixel data in the embodiment 1.

FIGS. 13(*e*) to 13(*i*) are diagrams of potential values at times (e)–(i), respectively, in FIG. 12 when writing remaining 2-bit image data in the embodiment 2.

DETAILED DESCRIPTION OF THE PREFERRED EMBODIMENTS (Embodiment 1)

Figure 1:
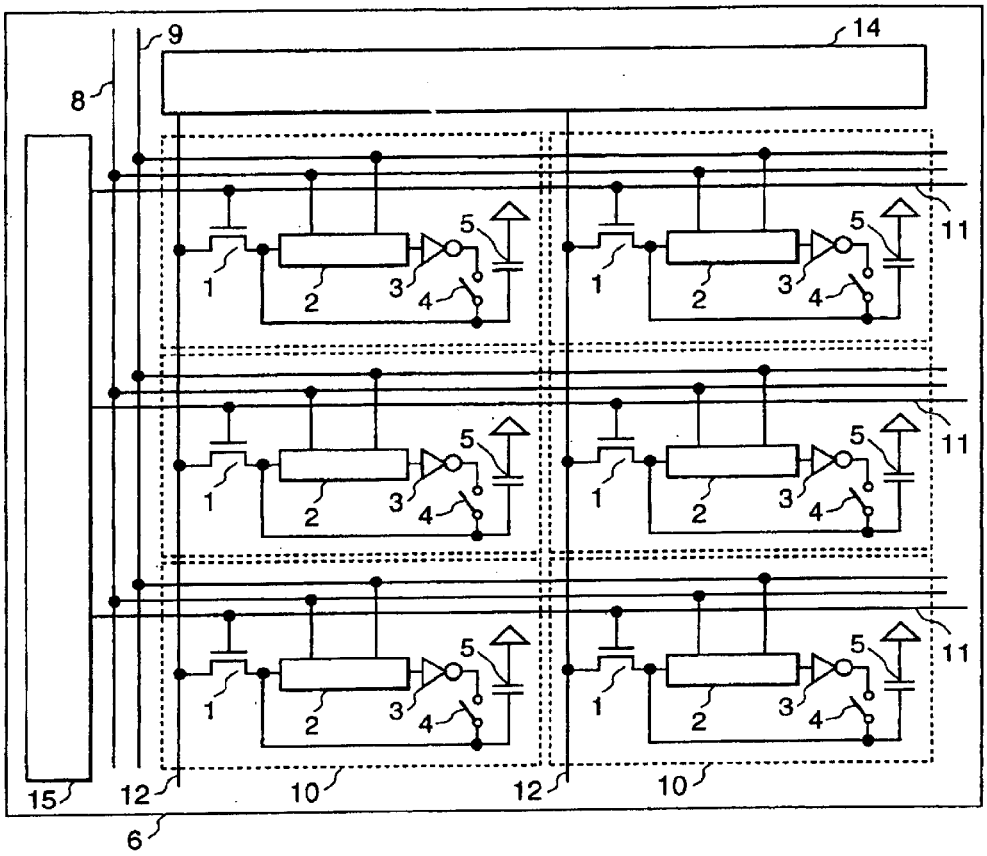
FIG. 1 is a block diagram of a Poly Si-TFT liquid crystal display panel forming an embodiment 1.

Referring to FIGS. 1 to 9, embodiment 1 of the present invention will be described. At first, the overall configuration of this embodiment will be described. FIG. 1 is a diagram of a poly SI-TFT liquid crystal display panel.

The pixels 10 having a liquid crystal capacitance 5 are arranged in the form of a matrix in the display portion of the panel (only 6 pixels are shown in FIG. 1 for simplification). The pixel 10 is connected to the gate line drive circuit 15 through the gate line 11, and it is connected to the signal line drive circuit 14 through the signal line 12. The pixel 10 has a DRAM (Dynamic Random Access Memory) composed of the data input switch 1 and the liquid crystal capacitance 5, and the other terminal of the data input switch 1 is connected to the signal line 12. The data hold node of the DRAM is input to a BBD (Bucket Brigate Device) 2 to be described later, and the output of the BBD is applied to the data hold node of the DRAM through the inverter 3 and the rewrite switch 4. The BBD 2 of each individual pixel is connected in common to the first BBD drive line 8 and the second BBD drive line 9. The above components are formed on the glass substrate 6.

The outline of the operation of this embodiment will be described. As the gate line drive circuit 15 opens and closes the data input switch 1 for the designated pixel line through the gate line 11, the pixel data supplied on the signal line 12 by the signal line drive circuit 14 are put into the DRAM composed of the data input switch 1 and the liquid crystal capacitance 5 for every individual 1-bit data. The liquid crystal capacitance 5 can display the images with the image data written into the DRAM. The image data written into the DRAM are read out bit by bit into BBD by BBD 2 driven by the first BBD drive line 8 and the second BBD drive line 9. The individual pixel in this embodiment can display 3-bit data by using plural memories installed inside the pixel, and can store image data having at most a 3-bit length sequentially into the BBD. Next, the image data stored in the BBD are rewritten again into the DRAM composed of the liquid crystal capacitance 5 through the inverter 3 and the rewrite switch 4. This operation is equivalent to the refresh of DRAM data, in which the image data changes its value between "H" and "L" owing to the operation of the inverter 3. By driving the liquid crystal common electrode (not shown) in synchronization with this rewrite operation, AC drive for the liquid crystal can be realized.

By employing the above configuration and operation, it will be a appreciated that the data in the DRAM can be refreshed periodically, and 3-bit image data can be displayed with a simplified pixel configuration in this embodiment as well. Though a simplified DRAM circuit is used for the memory inside the pixel in this embodiment, no external operation for rewriting the image data is required, and the signal line 12 is not required to be driven for the refresh operation.

Figure 2:
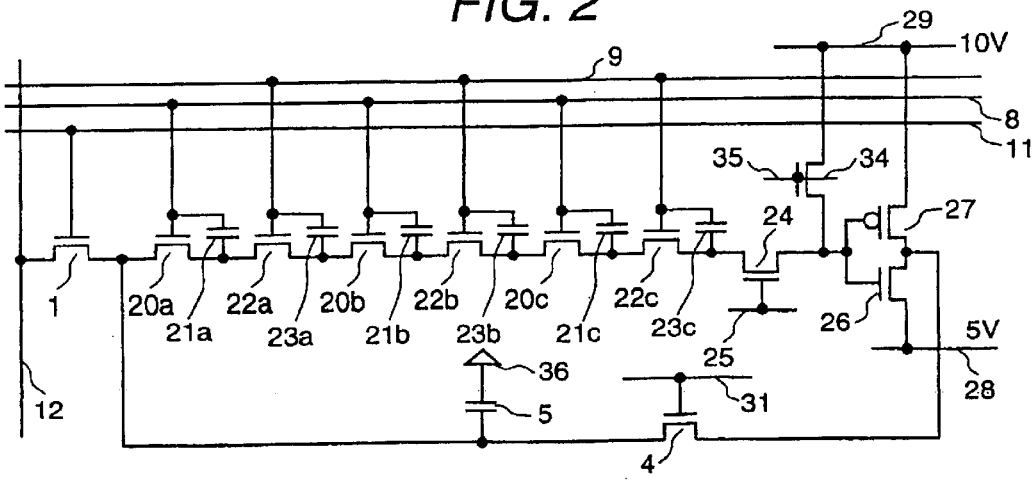
FIG. 2 is an internal circuit diagram of the pixel in the embodiment 1.

Next, the structure of the pixel including the BBD and its operation will be described with reference to FIG. 2, which shows the internal structure of the pixel 10 in this embodiment.

The DRAM composed of the data input switch 1 and the liquid crystal capacitance 5 is formed in the pixel 10, and the other terminal of the data input switch 1 is connected to the signal line 12. The component 36 is a liquid crystal common electrode. The 3-bit BBD 2 into which the image data are supplied from the data hold node of the DRAM is composed of a data transfer part comprising switches 20*a*, 22*a*, 20*b*, 22*b*, 20*c* and 22*c*, and capacitances 21*a*, 23*a*, 21*b*, 23*b*, 21*c* and 23*c*, and the data output part comprising the output gate 24 and the reset switch 34. The output from the BBD 2 is applied to a CMOS (Complementary MOS) inverter 3 composed of pMOS driver 27 and NMOS driver 26, and its output is again applied 25 to the data hold node of the DRAM through the rewrite switch 4. As for the individual switches and capacitances of the BBD 2, the switches 20*a*, 20*b* and 20*c* and the capacitances 21*a*, 21*b* and 21*c* are connected to the first BBD drive line 8, and the switches 22*a*, 22*b* and 23*c* and the capacitances 23*a*, 23*b* and 23*c* are connected to the second BBD drive line 9, respectively. The output gate 24 and the gates of the reset switch 34 and the rewrite switch 4 are connected to the output gate line 25, the reset gate line 35, and the rewrite gate line 31, respectively. The drain of the reset switch 34 and the high voltage terminal of the CMOS inverter 3 are connected to a 10V power supply line 29, and the low voltage terminal of the CMOS inverter 3 is connected to a 5V power supply line 28.

The operation of the pixels in this embodiment will be described. In this embodiment, in the state in which the BBD is not operated, that is, the pixel memory is not used, multi-value mode display or analog mode display operations enabling a motion picture display can be provided, which will be explained at first.

As described above, as the gate line drive circuit 15 opens and closes the data input switch 1 for the designated pixel line through the gate line 11, the image data supplied onto the signal line 12 by the signal line drive circuit 14 are applied to the liquid crystal capacitance 5 through the data input switch 1. The rewrite switch 4 is kept off by the rewrite gate line 31. The image data rewrite operation in this state is equivalent to that ordinary TFT liquid crystal displays, which enables multi-value mode display or analog mode display operations independently whether the liquid crystal common electrode is driven in the DC mode or the AC mode. In this case, an identical voltage is preferably applied down to the 10V electric power line 29 the and 5V electric power line 28 in order to reduce the electric power consumption. It is preferable to always turn off the first BBD drive line 8 and the second BBD drive line 9 in order to avoid parasitic effect in the BBD.

Next, by referring to FIGS. 3 and 5(*a*) to 5(*g*), the operation for writing the 3-bit digital image data into the pixel will be described.

Figure 3:
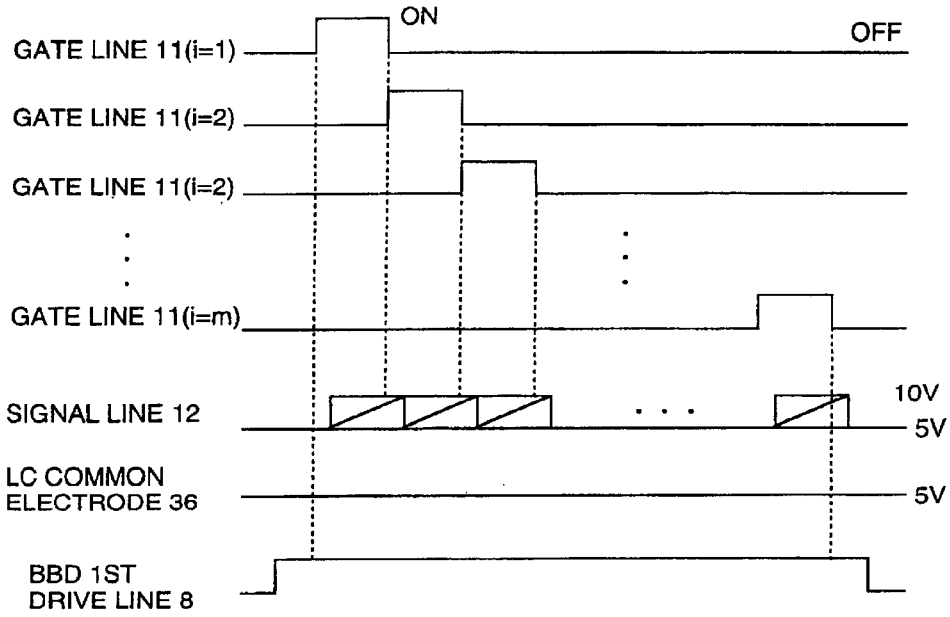
FIG. 3 is a timing diagram showing drive signal waveforms of signals produced when writing 1-bit pixel data in the embodiment 1.

FIG. 3 shows drive signal waveforms on the gate line 11 (i corresponds to the row number of the gate line), an arbitrary signal line 12, the liquid crystal common electrode 36, and the first BBD drive line 8, when writing the 1-bit digital image data into the overall pixels, in which the number of pixels is assumed to be m rows. In the individual drawings, the upward direction in the waveform means an ON state or high voltage, and the downward direction in the waveform means an OFF state or low voltage. For writing 1-bit pixel data, the first BBD drive line 8 is turned on at first, and next, the data input switches for the individual rows scanned by the gate line 11 are turned on sequentially. Image data are put into the signal line 12 with a little delay relative to the drive pulse on the gate line 11. At the end of the above operations, writing 1-bit image data for the overall pixels scanned by the gate line 11 is completed. The voltage of the liquid crystal common electrode 36 has a constant value.

Next, the operation of the pixels when writing the 3-bit digital image data will be described.

Figure 4:
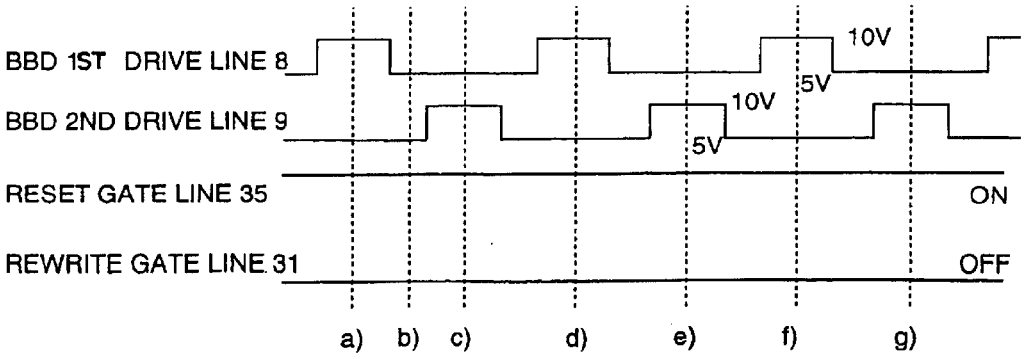
FIG. 4 is a timing diagram showing drive signal waveforms of signals produced when writing 3-bit pixel data in the embodiment 1.
Figure 5A:
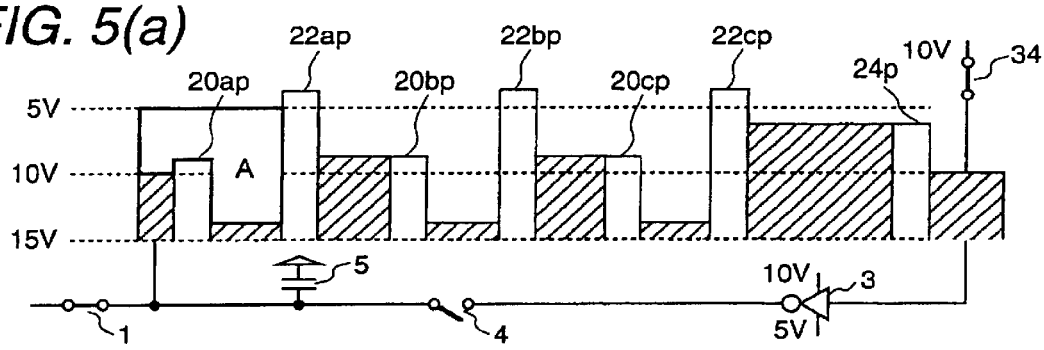
FIGS. 5(*a*) to 5(*c*) are diagrams of potential values at times (a)–(c), respectively, in FIG. 4 when writing 1-bit pixel data in the embodiment 1.
Figure 5B:
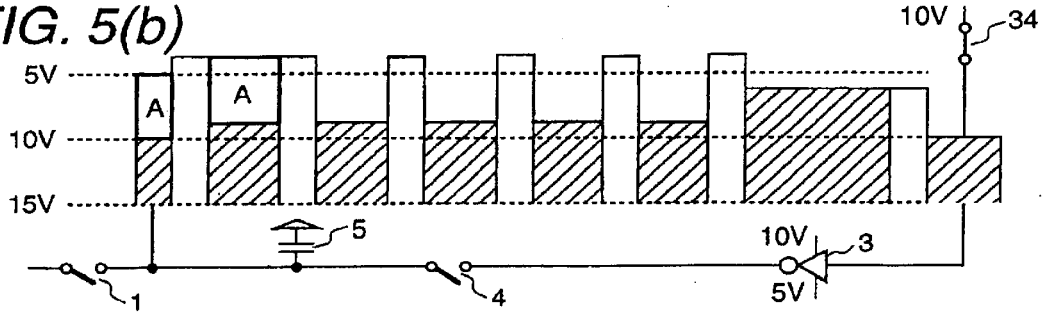
Figure 5C:
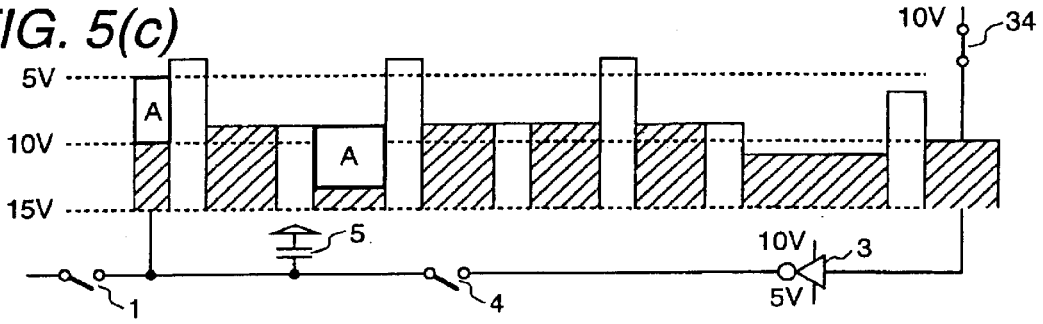
Figure 5D:
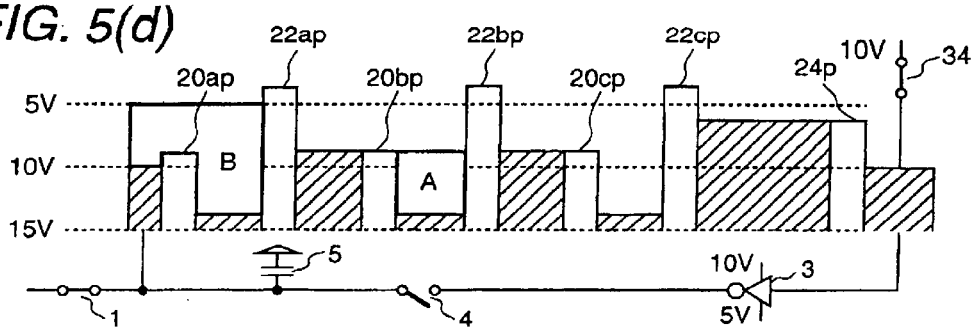
Figure 5E:
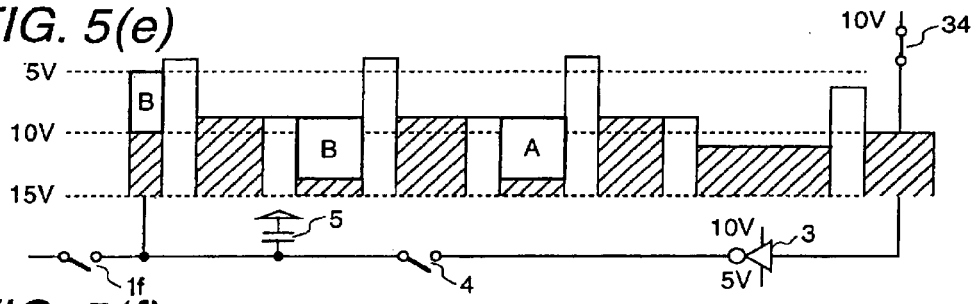
Figure 5F:
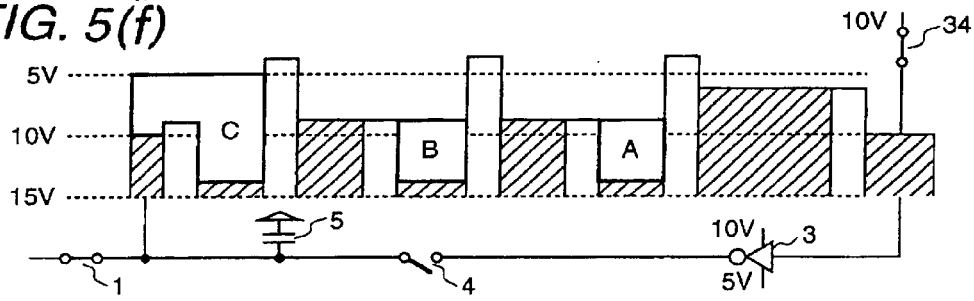
Figure 5G:
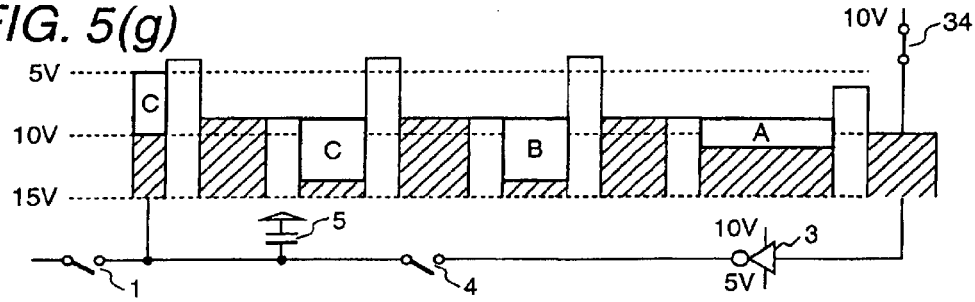

FIG. 4 shows drive signal waveforms on the first BBD drive line 8, the second BBD drive line 9, the reset gate line 35 and the rewrite gate line 31. FIGS. 5(*a*) to 5(*c*) and 6(*a*) to 6(*d*) show channel potentials of the BBD at the individual points (a) to (g) in FIG. 4, respectively. In these drawings, the downward direction in the potential means positive values. The channel potentials at the switches 20*a*, 22*a*, 20*b*, 22*b*, 20*c* and 22*c* and the output gate 24 are illustrated by the lines 20*ap*, 22*ap*, 20*bp*, 20*cp*, 22*cp* and 24*p*. The symbols A, B and C denote the signal charge (equivalent to electrons in this example) representing 3-bit image data at the individual pixel, and the levels of data, "L" and "H" direct an existence of the signal charges. For the convenience of explanation, all the signal charges in A, B and C are explicitly illustrated in the figure.

By referring to FIGS. 5(*a*) to 5(*g*), the drive signal waveforms and the changes in the channel potentials in the BBD for the individual time points (a) to (g), respectively, in FIG. 4 will be described. When writing 3-bit image data, the reset switch 34, which is driven by the reset gate line 35, is always in an On state for all the points from (a) to (g), and, thus, it continues to clear the charge supplied from the BBD. At the same time, the rewrite switch 4 driven by the rewrite gate lines 31 is turned off, which inhibits the rewrite operation of the output of the inverter 3 for the liquid crystal capacitance.

By referring to FIG. 4 and FIGS. 5(*a*), 5(*b*) and 5(*c*), the operation for reading 1-bit digital pixel data from the signal line 12 to the BBD in the pixel will be described at first.

FIG. 5(*a*): This case corresponds to the state in which the first BBD drive line 8 is ON and the second BBD drive line 9 is OFF, that is, the case of the timing of the writing of 1-bit image data to the individual pixels described with reference to FIG. 3. As the switch 20*a* is turned on, the signal charge A supplied through the data input switch 1 from the signal line 12, when the gate line 11 is ON, is also supplied to and held by the capacitance 21*a*, as well as by the liquid crystal capacitance 5.

FIG. 5(*b*): The switch 20*a* is turned on as the first BBD drive line 8 is turned off, and then, the signal charge A is kept between a couple of potential walls, 20*ap* and 22*ap*.

FIG. 5(*c*): The signal charge A transfers through the switch 22*a* to the capacitance 23*a* as the second BBD drive line 9 is turned on, and then it is kept between a couple of potential walls, 22*ap* and 20*bp*.

Next, by referring to FIG. 4 and FIGS. 5(*d*), 5(*e*), 5(*f*) and 5(*g*), the operation for reading the consecutive 2-bit digital pixel data will be described.

FIG. 5(*d*): This case also corresponds to the state in which the first BBD drive line 8 is ON and the first BBD drive line 9 is OFF, that is, the case of the timing of writing 1-bit image data to the individual pixels described with reference to FIG. 3. As the switch 20*a* is turned on, the signal charge B supplied through the data input switch 1 from the signal line 12, when the gate line 11 is ON, is also supplied to and held by the capacitance 21*a*, as well as by the liquid crystal capacitance 5. At the same time, the signal charge A transfers through the switch 20*b* to the capacitance 21*b*, and then it is kept between a couple of potential walls, 20*bp* and 22*bp*.

FIG. 5(*e*): This case also corresponds to the state in which the first BBD drive line 8 is OFF and the first BBD drive line 9 is ON, in which the signal charge A transfers through the switch 22*b* to the capacitance 23*b* and is kept between a couple of potential walls, 22*bp* and 20*cp*.

FIG. 5(*f*): This case also corresponds to the state in which the first BBD drive line 8 is ON and the first BBD drive line 9 is OFF, that is, the case of the timing of the writing of 1-bit image data to the individual pixels described with reference to FIG. 3. As the switch 20*a* is turned on, the signal charge C supplied through the data input switch 1 from the signal line 12, when the gate line 11 is ON, is also supplied to and held by the capacitance 21*a*, as well as by the liquid crystal capacitance S. At the same time, the signal charge A transfers through the switch 20*b* to the capacitance 21*b*, and then it is kept between a couple of potential walls, 20*bp* and 22*bp*. At the same time, the signal charge A transfers through the switch 20*c* to the capacitance 21*c*, and then it is kept between a couple of potential walls, 20*cp* and 22*cp*.

FIG. 5(*g*): This case also corresponds to the state in which the first BBD drive line 8 is OFF and the first BBD drive line 9 is ON, in which the signal, charge C transfers through the switch 22*a* to the capacitance 23*a* and is kept between a couple of potential walls, 22*ap* and 20*bp*. At the same time, the signal charge B transfers through the switch 22*b* to the capacitance 23*b* and is kept between a couple of potential walls, 22*bp* and 20*cp*. At the same time, the signal charge A transfers through the switch 22*c* to the capacitance 23*c* and is kept between a couple of potential walls, 22*cp* and 24*p*.

Reading 3-bit digital pixel data into the pixels is completed at the end of the above described operations. Though it is not explicitly recognized from FIG. 5(*a*) to FIG. 5(*g*), the capacitance value of the capacitance 23*c* is larger than the values of the BBD capacitances 21*a*, 23*a*, 21*b*, 23*b* and 21*c*, and is designed to be approximately twice as large as the value for other BBD capacitances in this embodiment. This will be described again in the explanation of FIGS. 7(*a*) to 7(*e*).

Next, the operations for displaying and rewriting 3-bit digital image data at the pixels will be described with reference to FIGS. 6 to 8.

Figure 6:
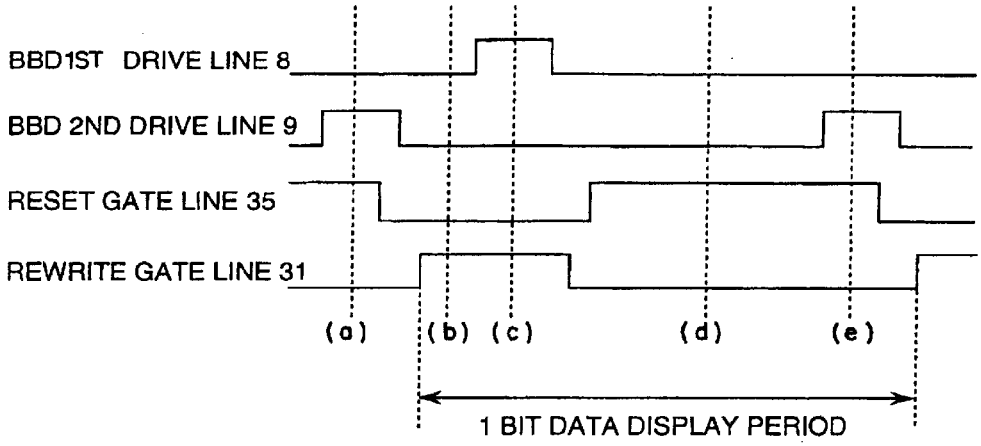
FIG. 6 is a drive signal diagram showing waveforms of signals produced when displaying and rewriting image data in the embodiment 1.

FIG. 6 shows drive signal waveforms on the first BBD drive line 8, the second BBD drive line 9, the reset gate line 35 and the rewrite gate line 31 in the operations of displaying and rewriting the 3-bit digital image data. FIGS. 7(*a*) to 7(*e*) show channel potentials of the BBD at the individual time points (a)–(e), respectively, in FIG. 6. In these figures, the downward direction in the potential means positive values. The channel potentials at the switches 20*a*, 22*a*, 20*b*, 22*b*, 20*c* and 22*c* and the output gate 24 are illustrated by the lines 20*ap*, 22*ap*, 20*bp*, 20*cp*, 22*cp* and 24*p*. The symbols A, B and C denote the signal charge representing 3-bit image data at the individual pixel, and the levels of data, "L" and "H", direct an existence of the signal charges. The symbol /A denotes a reverse signal of A, and if there is a signal charge in A, for example, there is no signal charge in /A. However, for the convenience of explanation, the signal charge /A is also illustrated hypothetically in the physical existence as well as signal charges A, B and C in the figure.

By referring to FIGS. 6 and 7(*a*) to 7(*e*), the drive signal waveforms of the changes in the channel potentials in the BBD for the individual time points (a) to (e), respectively, will be described. For all of the time points from (a) to (e), the gate line 11 and the data input switch 1 controlled by this line are OFF, and a DC voltage is applied to the signal line 12 or the signal line 12 is grounded in order to prevent electric power consumption.

FIG. 7(*a*): This case a so corresponds to the state wherein the first BBD drive line 8 is OFF and the first BBD drive line 9 is ON. The signal charge C is kept between a couple of potential walls, 22*ap* and 20*bp*, the signal charge B is kept between a couple of potential walls, 22*bp* and 20*cp*, and the signal charge C is kept between a couple of potential walls, 22*cp* and 24*p*.

FIG. 7(*b*): Next, the reset switch 34 is turned off by the reset gate line 35, so that the input terminal of the inverter 3 is floating, and next, the signal charge A flows over the potential wall 24*p* of the output gate 24 and supplied to the input terminal of the inverter 3. Since a constant voltage is always applied to the output gate line 25, it should be noted that the level of the potential wall 24*p* has a constant value. The reason why a constant potential is provided to the potential wall 24*p* is to reduce the voltage level at the output terminal of the BBD, in which the resultant potential amplitude of the capacitance 23*c* becomes smaller than the value of other BBD capacitances. In order to prevent the overflow in the signal charge from the capacitance 23*c* at this time, it is required to make the value of the capacitance 23*c* larger than the value of other BBD capacitances. In this embodiment, as described before, the value of the capacitance 23*c* is so designed as to be approximately twice as large as the value of other BBD capacitances. As the signal charge A is supplied to the inverter 3, the inverter 3 outputs the inverted signal of A, that is, /A. Its output voltage is 10V when there exists a signal charge A with which the input voltage to the inverter 3 is approximately 6V, and its output voltage is 5V when there does not exit a signal charge A in which the input voltage to the inverter 3 is 10V for the reset state. In the next step, as the rewrite switch 4 is turned on by the rewrite gate line 31, the output voltage of the inverter 3 is applied to the liquid crystal capacitance 5 and the input terminal of BBD 2, and then, it is used for display.

FIG. 7(*c*): Next, by means of the first BBD drive line 8 being turned ON, as the switch 20*a* is ON, the signal charge /A supplied through the rewrite switch 4 from the inverter 3 is also input to the capacitance 21*a*, as well as to the liquid crystal capacitance 5. At the same time, the signal charge C transfers through the switch 20*b* to the capacitance 21*b* and is kept between a couple of potential walls, 20*bp* and 22*bp*. At the same time, the signal charge B transfers through the switch 20*c* to the capacitance 21*c* and is kept between a couple of potential walls, 20*cp* and 22*cp*.

FIG. 7(*d*): By means of the first BBD drive line 8 being turned OFF, the switch 20*a* is turned off, and then the signal charge /A is kept between a couple of potential walls, 20*ap* and 22*ap*. Next, as the rewrite switch 4 is turned of f by the rewrite gate line 31, the output of the inverter 3 is isolated from the liquid crystal capacitance 5, and the liquid crystal capacitance 5 holds the display output corresponding to the signal charge /A. Thereafter, as the reset switch is turned on by the reset gate line 35, the signal charge A is reset and the input of the inverter 3 returns again to 10V.

FIG. 7(*e*): By means of the second BBD signal line 9 being turned ON, the signal charge /A transfers through the switch 22*a* to the capacitance 23*a*, and is kept between a couple of potential walls, 22*ap* and 20*bp*. At the same time, the signal charge C transfers through the switch 22*b* to the capacitance 23*b* and is kept between a couple of potential walls, 22*bp* and 20*cp*. At the same time, the signal charge B transfers through the switch 22*c* to the capacitance 23*c* and is kept between a couple of potential walls, 22*cp* and 24*p*. This state is such that the signal charges are shifted forward by 1-bit from the state shown in FIG. 7(*a*).

In this embodiment, by repeating the operations shown in FIGS. 7(*a*) to 7(*e*), the output for the 3-bit digital image data can be displayed sequentially and the rewrite operation equivalent to the refresh operation of a DRAM can be performed simultaneously inside the pixel, without using the signal line 12 having a large parasitic capacitance and with lower electric power consumption. In this embodiment, every time the rewrite operation of 3-bit data into the liquid crystal capacitance 5 is completed in the end of a single data loop, the voltage applied to the liquid crystal common electrode 36 is inverted. With this operation, an AC drive of the liquid crystal capacitance 5 is realized as described before with reference to FIG. 1.

By simply displaying repetitively 3-bit digital image data at a constant rate, a 4-level gray scale image can not be displayed. In this embodiment, in order to solve this problem, 8-level (2 to the power of 3) gray scale image display can be established by altering the display periods for three sets of single-bit data so as to increase to display periods to twice as long. This operation will be described with reference to FIG. 8.

Figure 8:
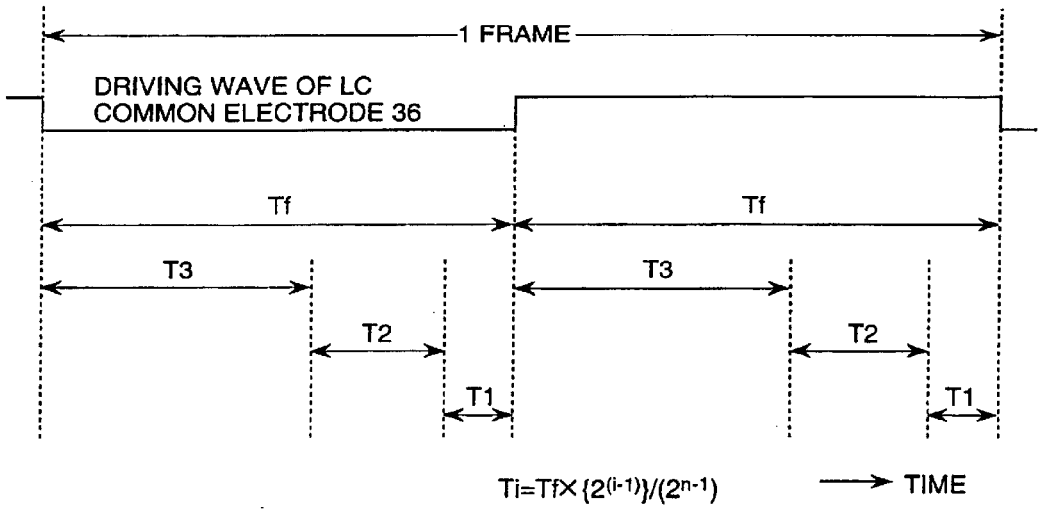
FIG. 8 is a display sequence chart of 3-bit image data in the embodiment 1.
Figure 7A:
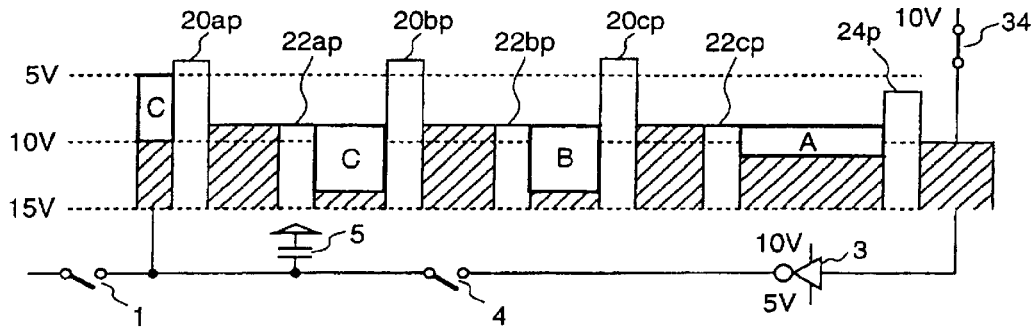
FIGS. 7(*a*) to 7(*e*) are diagrams of potential values at times (a)–(e), respectively, in FIG. 6 when displaying and rewriting image data in the embodiment 1.
Figure 7B:
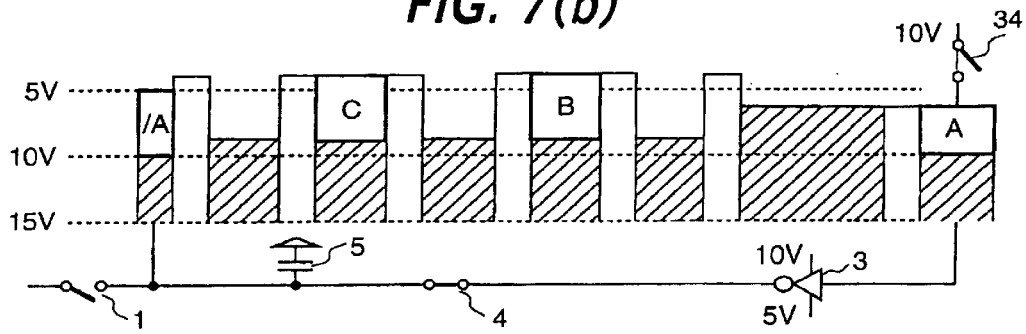
Figure 7C:
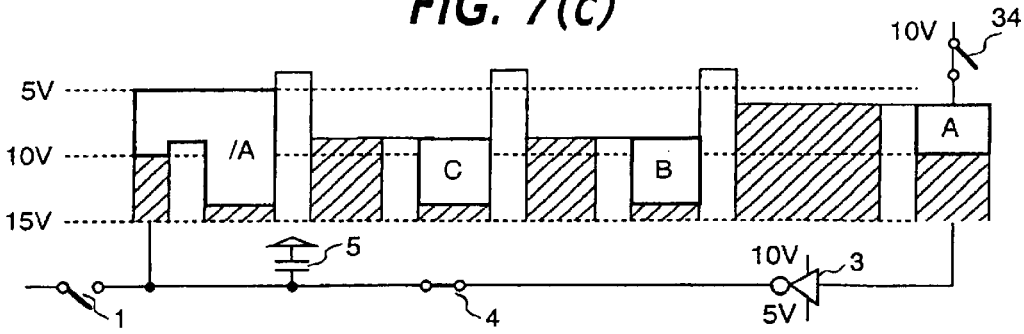
Figure 7D:
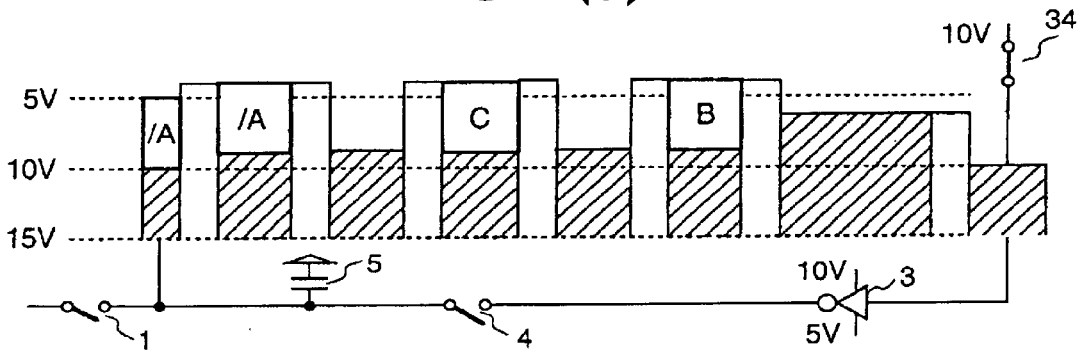
Figure 7E:
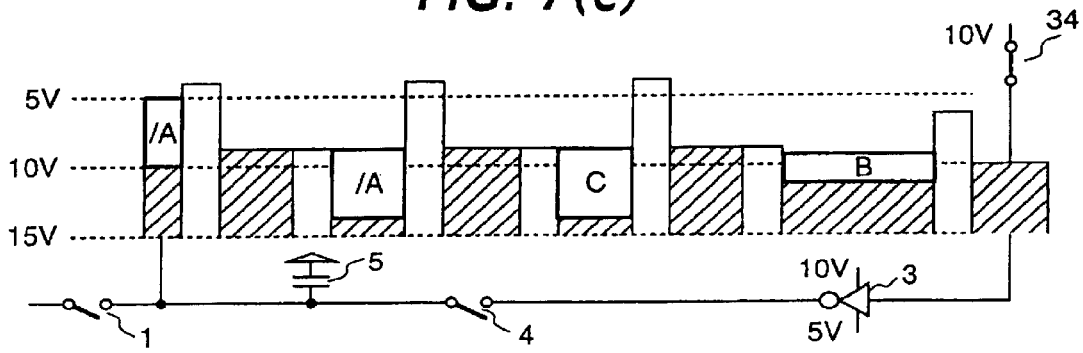

FIG. 8 shows a display sequence for 3-bit display data in a single frame period in accordance with this embodiment. The single frame period is composed of a couple of fields, in which the voltage applied to the liquid crystal common electrode 36 is altered from one field to another. In the individual field period, three sets of bit data are displayed for the display periods having their own length extended stepwise to twice the length as time goes on. The first bit (LSB: Least Significant Bit) is displayed for the period corresponding to 1/7 of the individual field period, the second bit is displayed for the period corresponding to 2/7 of the individual field period, and the third bit is displayed for the period corresponding to 4/7 of the individual field period, respectively. The display period for the i-th bit for displaying n-bit data is defined by the following equation.

$$Ti=Tf\times\{2^{(i-1)}\}/(2^n-1), \quad \text{[Formula 1]}$$

in which Ti is the display period of the i-th bit, and Tf is the length of the single field period.

The length of the single field period is half of the length of the single frame period, and its frame frequency is preferably defined so as to reduce flicker due to AC voltage drive and gray scale display in the liquid crystal. For example, the frame frequency is defined to be 60 Hz in this embodiment.

Though the waveform of the drive signal for the liquid crystal common electrode 36 is made consistent with the single frame period as shown in FIG. 8 in this embodiment, this drive signal may be made reversed for every bit and used for driving the electrode. In this case, for example, the drive signal to the liquid crystal common electrode 36 changes so as to be "H" for the period T3, "L" for the period T2, and "H" for the period T1 at first, and then "L" for the period T3, "H" for the period T2 and "L" for the period T1 in the next phase. Owing to this drive method, there is an advantage in that flicker can be reduced even when the length of the single frame period is made relatively longer.

Next, the device structures for the individual switches and the BBD in this embodiment will be described with reference to FIG. 9.

Figure 9:
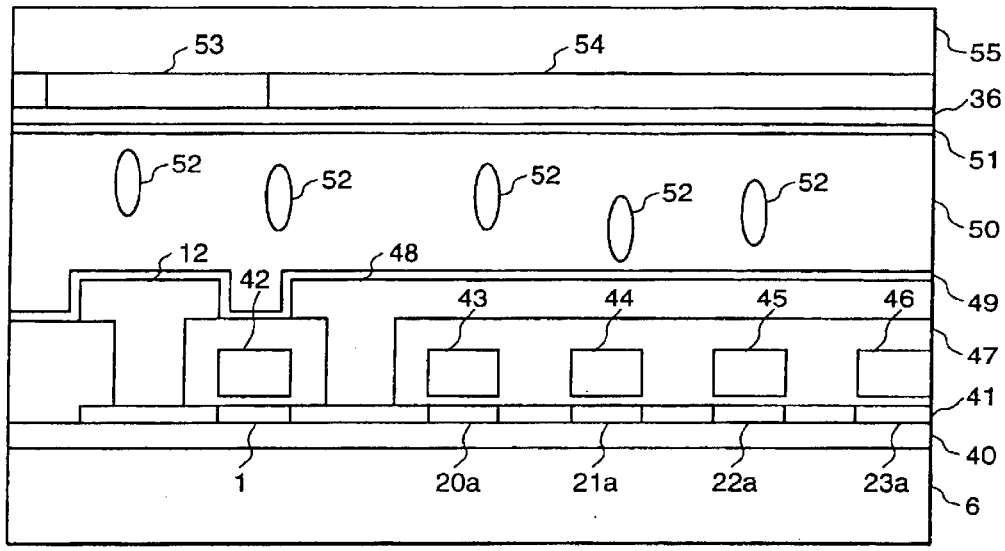
FIG. 9 is a cross-sectional view of a part of the pixel in the embodiment 1.

FIG. 9 shows a cross-sectional view of a part of the pixel in this embodiment. Polycrystalline Silicon (poly-Si) films 41 are formed on the glass substrate 5, between which the buffer film 40 is inserted, and furthermore, the electrodes 42, 43, 44, 45 and 46 and the insulation film 47 are formed on the poly-Si film 41. The electrode 42 is defined as the gate electrode of the data input switch 1, the electrode 43 is defined as the gate electrode of the switch 20*a* of the BBD 2, the electrode 44 is defined as the upper electrode of the capacitance 21*a* of the BBD 2, the electrode 45 is defined as the gate electrode of the switch 22*a* of the BBD 2, and the electrode 46 is defined as the upper electrode of the capacitance 23*a* of the BBD 2. The signal line 12 and the pixel electrode 48 are provided at both terminals of the data input switch 1, on which the oriented film 49 is formed. The color filter 54 and the light-block film 53 are formed on the opposed glass-substrate 55, on which the transparent liquid crystal common electrode 36 made of ITO (Indium Tin Oxide) and the oriented film 51 are formed. The liquid film layers 50 containing liquid crystal molecules 52 are filled in the space between the glass substrate 6 and the opposed glass substrate 55, which resultantly establishes the liquid crystal capacitance 5 between the pixel electrode 48 and the liquid crystal common electrode 36.

As apparent from the above, the data input switch 1 is composed of poly-Si TFT (Thin-Film-Transistor), and the channel for the data input switch 1 and the BBD 2 is formed by a poly-Si thin film as well. The electrodes 42, 43, 44, 45 and 46 of the data input switch 1 and the BBD 2 are formed by a conductive electrode layer composed of an identical material. In this embodiment, the simplification in the manufacturing process and the reduction of the cost can be attained by using common materials as the composition for the data input switch 1 and the BBD 2. An identical threshold voltage (Vth) is defined for the channels below the gates of the data input switch 1 and the switches 20*a*, 22*a*, 20*b*, 22*b*, 20*c* and 22*c* by an identical process for implanting impurities, and high concentration impurities are doped into the poly-Si layers for the capacitances 21*a*, 23*a*, 21*b*, 23*b*, 21*c* and 23 for preventing depletion.

The extension of the pixel electrode 48 over the BBD2 has the objective of providing the pixel electrode 48 as a reflection electrode for the external light, and thus, the scattering characteristics for the incoming light can be established by making its surface concavo-convex, if required. By employing the above described structure, a reflection-type liquid crystal display can be established in this embodiment. Though it is not shown in the figure, the pixel electrode 48 covers approximately half of the overall pixel, and the other half is formed as a transparent electrode using ITO. A designated back-light device (not shown) is formed below the glass substrate 6, and by switching this back-light device properly, a transmission-type liquid crystal display can be also established by this apparatus.

Various modifications can be made in the embodiment described without departing from the spirit and scope of the present invention. Though the glass substrate 6 is used as TFT substrate in this embodiment, a translucent insulating substrate, such as quartz-base substrate or translucent plastic substrate, can be use alternatively, and a reflection-type liquid crystal display is exclusively employed instead of the transmission-type liquid crystal display, with which opaque substrates can be used.

As for the TFT and BBD, though nMOS is used for the data input switch 1 in this embodiment, proper modifications necessary for the drive signal waveform can make it possible to substitute pMOS and CMOS for this composition material. As for the inverter 3, another type of inverter other than a CMOS inverter can be used.

In this embodiment, as described above, since the channels and electrodes for the data input switch 1 and BBD 2 are formed by identical processes, and the composition materials for the data input switch 1 and BBD 2 are made of common materials, a simplification of the manufacturing processes and a reduction in the cost can be attained. It is, however, not necessary to apply those composition materials to the individual components in order to attain such an effect as defined as the object of the present invention.

In the description of this embodiment, the number of pixels and the size of the panel are not referred to. This is because the present invention is not limited to those parameters, specifications and formats. Though the display performance is defined as 3-bit with 8-gray scales for using DRAM pixel memories in this embodiment, the present invention is not limited to any specific bit length, which can be established merely by varying the number of channels of the BBD 2. As for the drive voltage in the pixel part, its optimal voltage may be determined on the basis of the material used for the liquid crystal, its drive scheme, and the design parameters of the external electric power source.

Various modifications described above may be basically applied similarly to embodiments other than this embodiment.

(Embodiment 2)

Next, an embodiment 2 of the present invention will be described with reference to FIGS. 10 to 15(*e*).

The overall configuration and the operation of this embodiment are basically equivalent to those of the embodiment 1 described with reference to FIG. 1, excluding the structure of the BBD (Bucket Brigade Device) 2 and its drive method. Thus, the overall configuration and the operation of this embodiment are not described in detail, but the pixels and the BBD featuring this embodiment will be mainly described.

Figure 10:
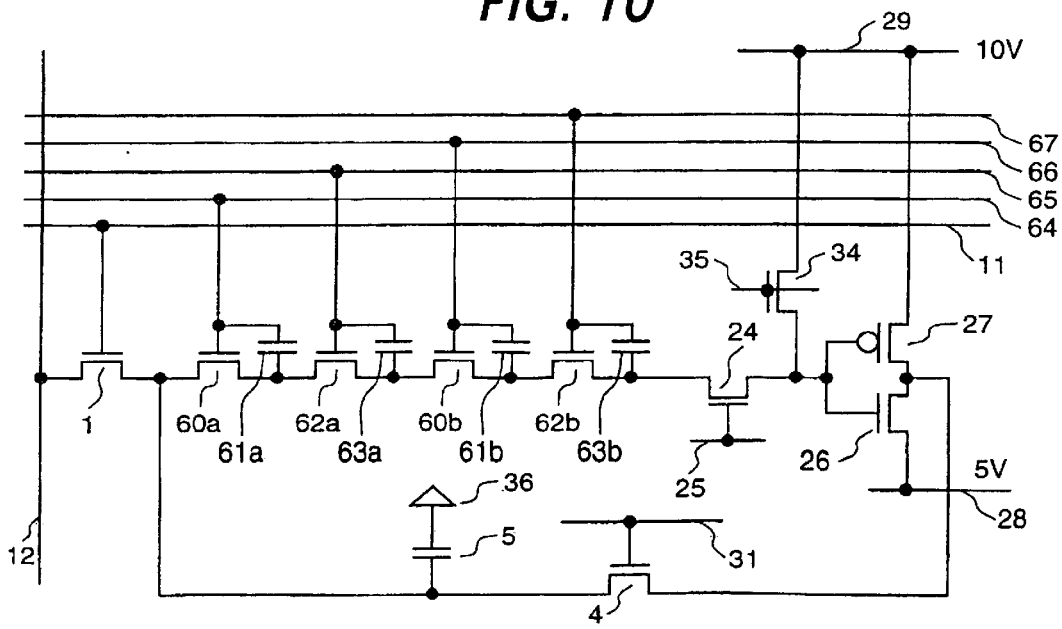
FIG. 10 is a circuit diagram of the pixel in the embodiment 2.

The detailed structure of the pixel 10, including the BBD and its operation will be described with reference to FIG. 10, which shows an internal structure of the pixel according to this embodiment. A DRAM composed of the data input switch 1 and the liquid crystal capacitances is formed in the pixel 10, and the terminal of the data input switch 1 is connected to the signal line 12. The component 36 is a liquid crystal common electrode. The BBD for storing 3-bit data supplied from the data hold node of the DRAM is composed of a data transfer part comprising switches 60*a*, 62*a*, 60*b* and 62*b*, and capacitances 61*a*, 63*a*, 61*b* and 63*b*, and a data output part comprising the output gate 24 and the reset switch 34. The output of the BBD is input to a CMOS (Complementary MOS) inverter 3 composed of the pMOS driver 27 and the nMOS driver 26, and its output is input again to the data hold node of the DRAM through the rewrite switch 4. The individual switches and their capacitances of the BBD are different from those in the embodiment 1, in that the switch 60*a* and the capacitance 61*a* are connected to the first BBD drive line 64, the switch 62*a* and the capacitance 63*a* are connected to the second BBD drive line 65, the switch 60*b* and the capacitance 61*b* are connected to the third BBD drive line 66, and the switch 62*b* and the capacitance 63*b* are connected to the forth BBD drive line 67, respectively. The output gate 24 and the gates of the reset switch 34 and the rewrite switch 4 are connected to the output gate line 25, the reset gate line 35 and the rewrite gate line 31, respectively. The drain of the reset switch 34 and the high-voltage terminal of the CMOS inverter 3 are connected to the 10V electric power line 29, and the low-voltage terminal of the CMOS inverter 3 is connected to the 5V electric power line 28.

Now, the operations of the pixel in this embodiment will be described. Since ordinary multi-value display or analog display operations in this embodiment, in the case where the BBD is not operated, that is, when the pixel memory is not used, are similar to the first embodiment, those operations will not be described here. In the case where the pixel memory is not used, the rewrite switch 4 may be held in the off state by the write gate line 31, and thus, an identical lower voltage is preferably applied to the electric power line 29 and the 5V electric power line 28 in order to reduce the electric power consumption. It is preferable to always turn off the first BBD drive line 64 and the second BBD drive line 65, the third BBD drive line 66 and the fourth BBD drive line 67 in order to avoid the parasitic effect in the BBD.

Next, by referring to FIGS. 11, 12 and 13(*a*) to 13(*i*), the operation for writing the 3-bit digital image data into the pixel will be described.

Figure 11:
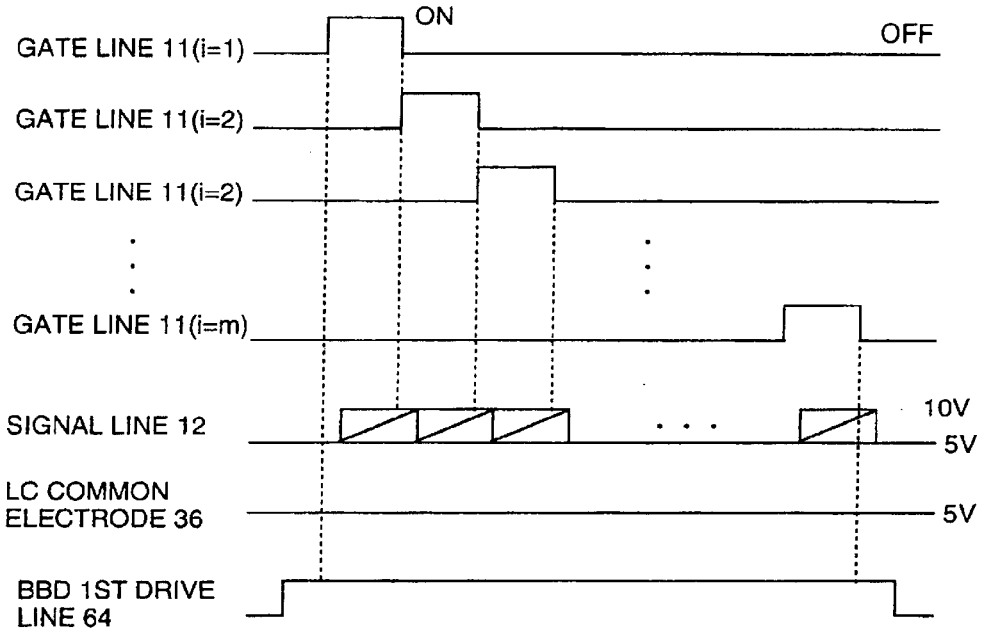
FIG. 11 is a diagram showing drive signal waveforms of signals produced when writing 1-bit pixel data in the embodiment 2.

FIG. 11 shows drive signal waveforms on the gate line 11, arbitrary signal line 12, the liquid crystal common electrode 36, and the first BBD drive line 64 when writing the 1-bit digital image data into the overall pixels, in which the number of pixels is assumed to be m rows. In the individual drawings, the upward direction in the waveform means an ON state or high voltage, and the downward direction in the waveform means an OFF state or low voltage. For writing 1-bit pixel data, the first BBD drive line 64 is turned on at first, and next, the data input switches for the individual rows scanned by the gate line 11 are turned on sequentially. Image data is applied to the signal line 12 with a little delay relative to the drive pulse on the gate line 11. At the end of the above operations, writing 1-bit image data for the overall pixels scanned by the gate line 11 is completed.

Next, the operation of the pixels when writing the 3-bit digital image data will be described.

Figure 12:
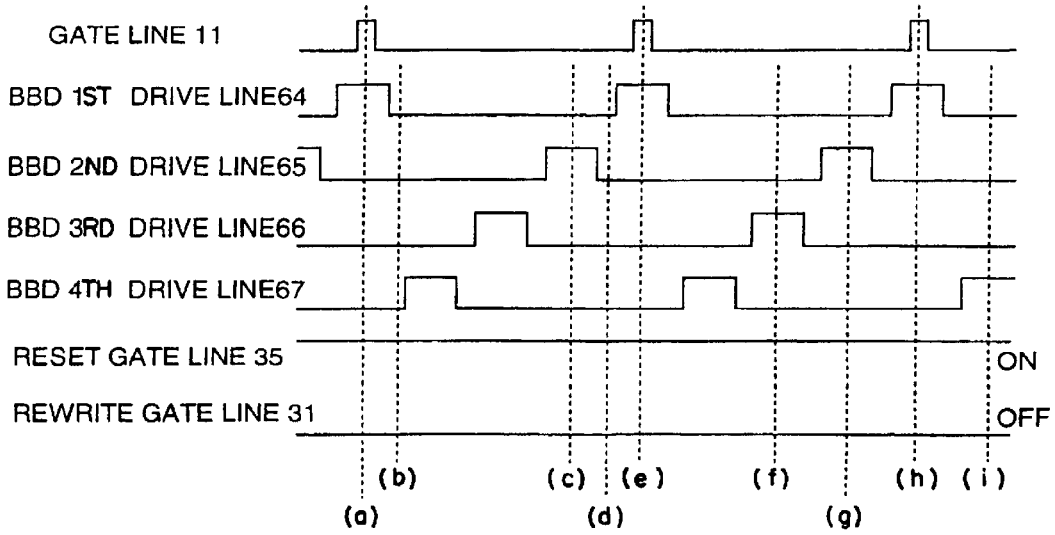
FIG. 12 is a diagram showing drive signal waveforms of signals produced when writing 3-bit pixel data in the embodiment 2.
Figure 13A:
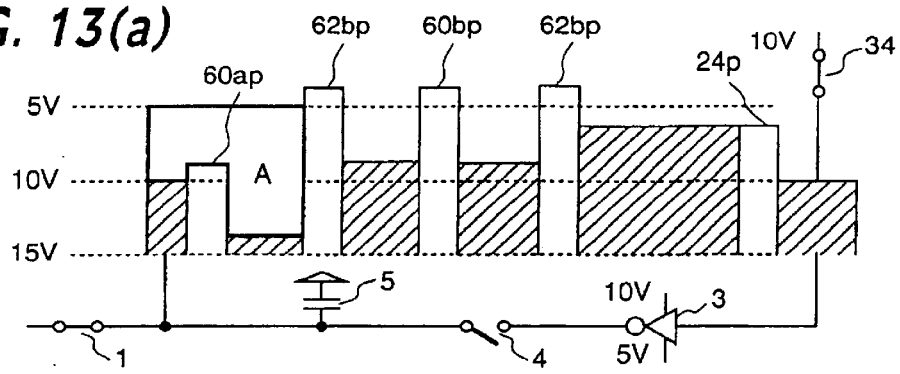
FIGS. 13(*a*) to 13(*d*) are diagrams of potential values at times (a)–(d), respectively, in FIG. 12 when writing 1-bit pixel data in the embodiment 2.
Figure 13B:
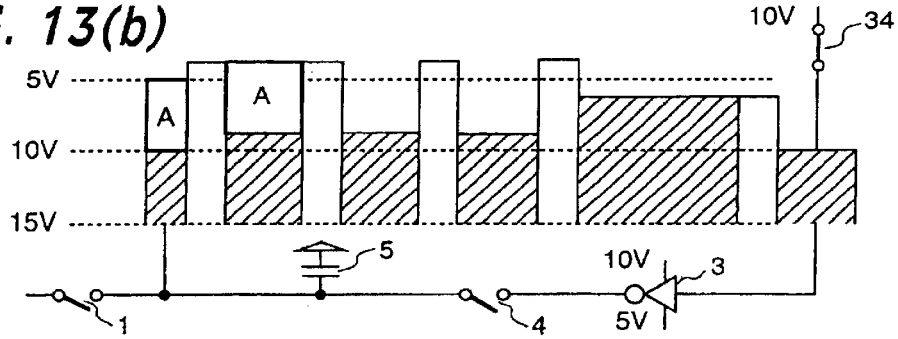
Figure 13C:
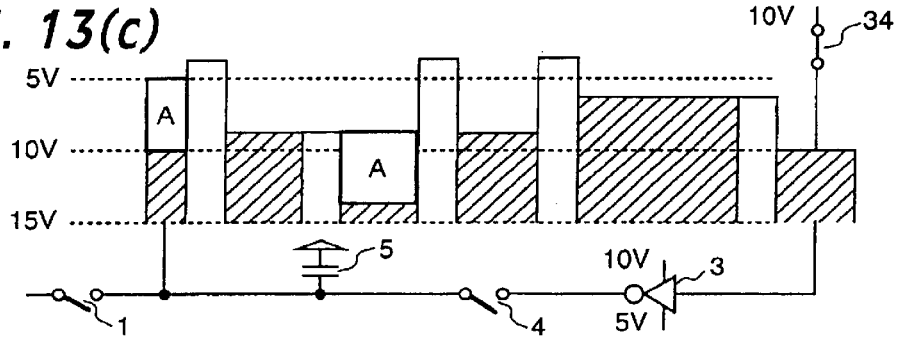
Figure 13D:
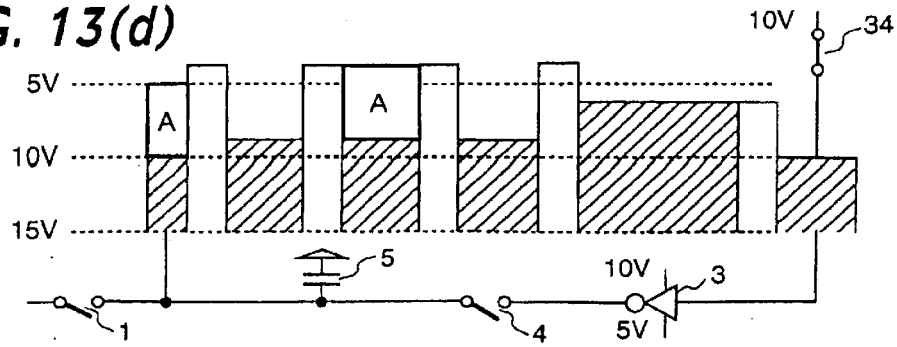
Figure 13E:
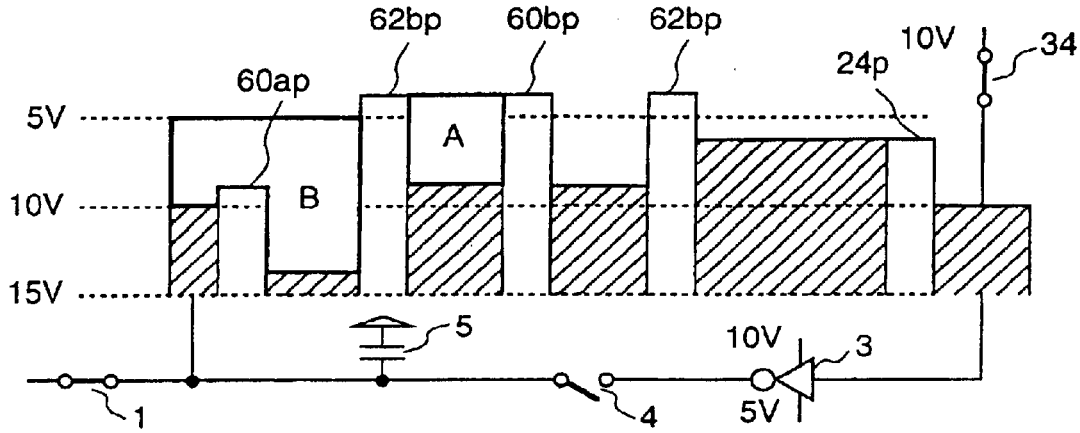
Figure 13F:
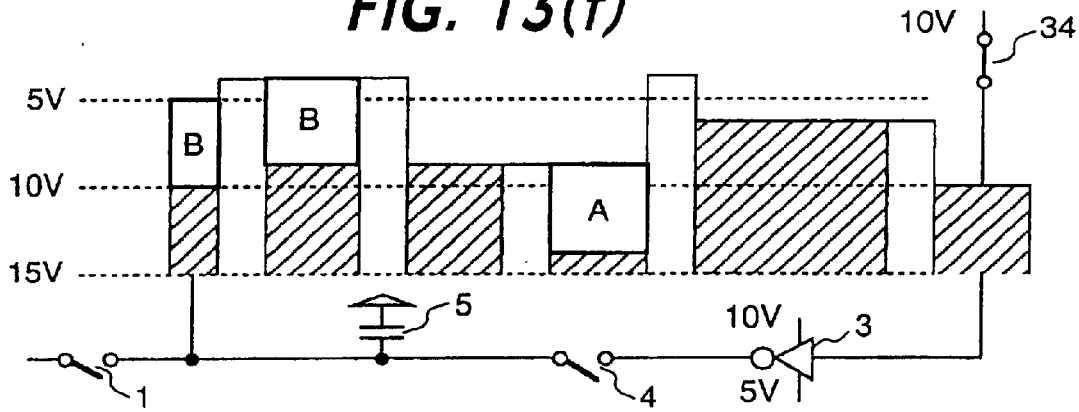
Figure 13G:
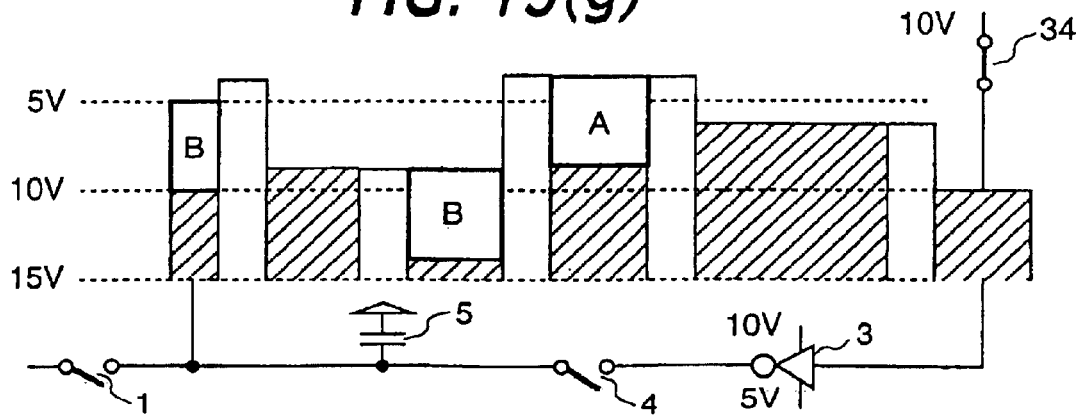
Figure 13H:
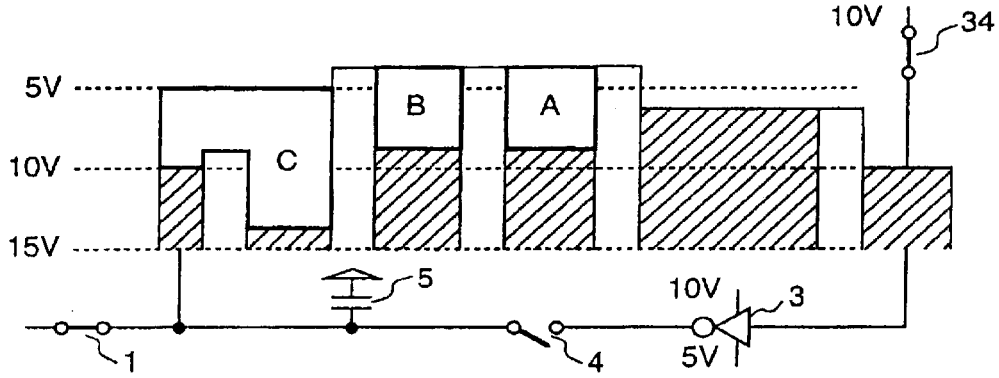
Figure 13I:
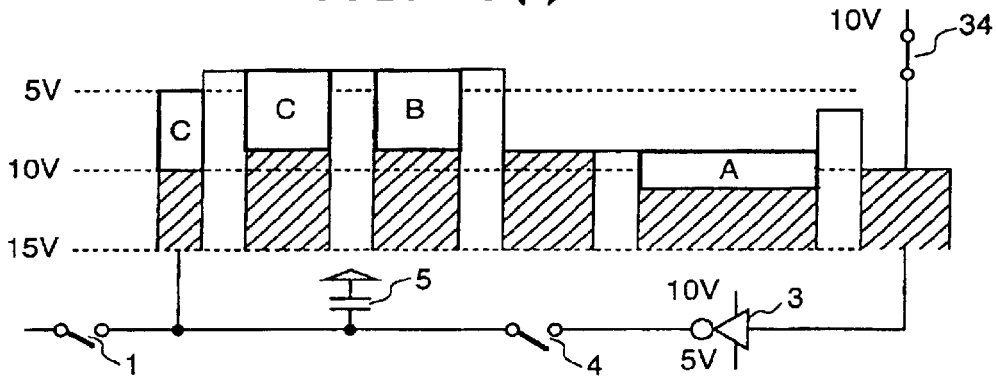

FIG. 12 shows drive signal waveforms on the gate line 11, the first BBD drive line 64, the second BBD drive line 65, the third BBD drive line 66, the forth BBD drive line 67, the reset gate line 35 and the rewrite gate line 31. FIGS. 13(*a*) to 13(*i*) show channel potentials of the BBD at the individual time points (a) to (i) in FIG. 12, respectively. In these figures, the downward direction in the potential means positive values. The channel potentials at the switches 60*a*, 62*a*, 60*b*, 62*b* and the output gate 24 are illustrated by the lines 60*ap*, 62*ap*, 60*bp*, 62*cp* and 24*p*. The symbols A, B and C denote the signal charge representing 3-bit image data at the individual pixel, and the levels of data, "L" and "H" direct an existence of the signal charges. For the convenience of explanation, all the signal charges in A, B and C are explicitly illustrated in the figure.

By referring to FIGS. 13(*a*) to 13(*i*), the drive signal waveforms and the changes in the channel potentials in the BBD for the individual time points (a) to (i) respectively shown in FIG. 12 will be described. When writing 3-bit image data, the reset switch 34 driven by the reset gate line 35 is always in an On state, and the rewrite switch 4 driven by the rewrite gate-line 31 is turned off for all the time points from (a) to (i), and thus they continue to clear the charge supplied from the BBD and, at the same time, inhibit the rewrite operation of the output of the inverter 3.

By referring to FIG. 12 and FIGS. 13(*a*), 13(*b*), 13(*c*) and 13(*d*), the operation for reading 1-bit digital pixel data from the signal line 12 to the BBD in the pixel will be described.

FIG. 13(*a*): This case corresponds to the state wherein the first BBD drive line 64 is ON and the second, third and fourth BBD drive lines 65, 66 and 67 are OFF, that is, the case of the timing of writing 1-bit image data to the individual pixels as described with reference to FIG. 11. As the switch 60*a* is turned on, the signal charge A supplied through the data input switch 1 from the signal line 12 when the gate line 11 is turned ON is also supplied to and held at the capacitance 61*a*, as well as in the liquid crystal capacitance 5.

FIG. 13(*b*): The switch 60*a* is turned off as the first BBD drive line 64 is turned off, and then, the signal charge A is kept between a couple of potential walls, 60*ap* and 62*ap*.

FIG. 13(*c*): The signal charge A transfers through the switch 62*a* to the capacitance 63*a* as the second BBD drive line 65 is turned on and then is kept between a couple of potential walls, 62*ap* and 60*bp*. At this time, though the fourth and third BBD drive lines 67 and 66 are turned on and off sequentially in a practical sense, the detailed operation will not be described because this operation involves the flushing of the residual charges in the BBD and hence has no relation to the writing of the signal charge A.

FIG. 13(*d*): The switch 62*a* is turned off as the second BBD drive line 65 is turned off. The signal charge A is still kept between a couple of potential walls, 62*ap* and 60*bp*.

Next, by referring to FIG. 12 and FIGS. 13(*e*), 13(*f*), 13(*g*), 13(*h*) and 13(*i*), the operation for reading the consecutive 2-bit digital pixel data will be described.

FIG. 13(*e*): This case also corresponds to the state wherein the first BBD drive line 64 is ON and the second, third and fourth BBD drive lines 65, 66 and 67 are OFF, that is, the case of the timing of writing 1-bit image data to the individual pixels as described with reference to FIG. 11. As the switch 60*a* is turned on, the signal charge B supplied through the data input switch 1 from the signal line 12 when the gate line 11 is turned ON is also supplied to and held at the capacitance 61*a*, as well as in the liquid crystal capacitance 5. The signal charge A is still kept between a couple of potential walls 62*ap* and 60*bp*.

FIG. 13(*f*): The third BBD drive line 66 is ON, and the first, second and fourth BBD drive lines 64, 65 and 67 are OFF. The signal charge B is kept between a couple of potential walls 60*ap* and 62*ap*. The signal charge A transfers through the switch 60*b* to the capacitance 61*b* and then is kept between a couple of potential walls 60*bp* and 62*bp*.

FIG. 13(*g*): The second BBD drive line 65 is ON, and the first, third and fourth BBD drive lines 64, 66 and 67 are OFF. The signal charge B transfers through the switch 62*a* to the capacitance 63*a* and then is kept between a couple of potential walls 62*ap* and 60*bp*. The signal charge A is still kept between a couple of potential walls 60*bp* and 62*bp*.

FIG. 13(*h*): This case also corresponds to the state wherein the first BBD drive line 64 is ON and the second, third and fourth BBD drive lines 65, 66 and 67 are OFF, that is, the case of the timing of writing 1-bit image data to the individual pixels described with reference FIG. 11. As the switch 60*a* is turned on, the signal charge C supplied through the data input switch 1 from the signal line 12 when the gate line 11 is turned ON is also supplied to and held at the capacitance 61*a*, as well as by the liquid crystal capacitance 5. The signal charge B is still kept between a couple of potential walls 62*ap* and 60*bp*. The signal charge A is still kept between a couple of potential walls 60*bp* and 62*bp*.

FIG. 13(*i*): The fourth BBD drive line 67 is ON, and the first, second and third BBD drive lines 64, 65 and 66 are OFF.

The signal charge C is kept between a couple of potential walls 60*ap* and 62*ap*. The signal charge B is still kept between a couple of potential walls 62*ap* and 60*bp*. The signal charge A transfers through the switch 62*b* to the capacitance 63*b* and is kept between a couple of potential walls 62*bp* and 24*p*.

Reading 3-bit digital pixel data into the pixels is completed at the end of the above described operations. As with the capacitance 23*c* in the embodiment 1, the value of the capacitance is larger than the values of other BBDs, and is designed to be approximately twice as large as the values for other BBDs in this embodiment.

Next, the operations for displaying and rewriting 3-bit digital image data, the pixels will be described with reference to FIGS. 14 and 15(*a*) to 15(*e*).

Figure 14:
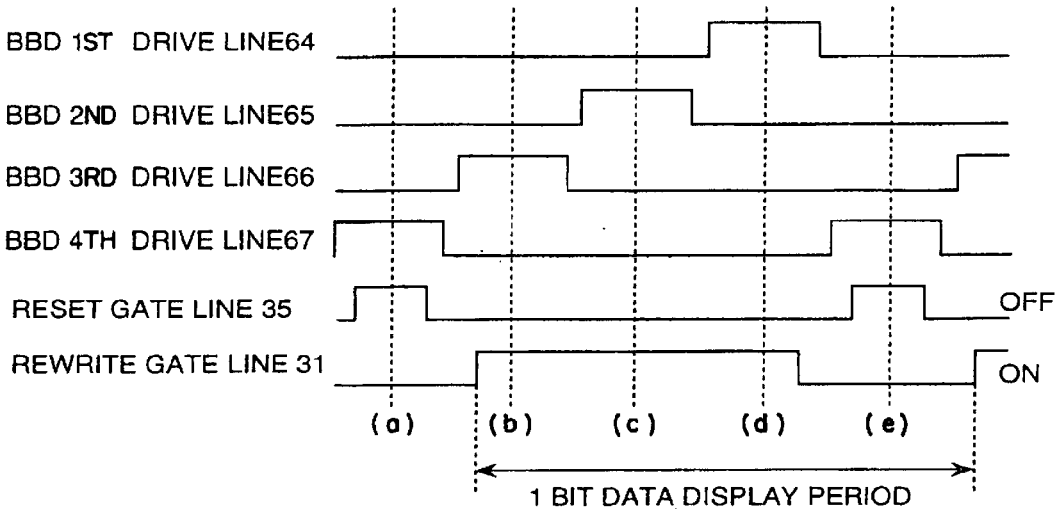
FIG. 14 is a diagram showing drive signal waveforms of signals produced when displaying and rewriting image data in the embodiment 2.

FIG. 14 shows drive signal waveforms on the first BBD drive line 64, the second BBD drive line 64, the third BBD drive line 65, the fourth BBD drive line 66, the reset gate line 35 and the rewrite gate line 31 in the operations of displaying and rewriting the 3-bit digital image data. FIGS. 15(*a*) to 15(*e*) show channel potentials of the BBD at the individual time points (a) to (e), respectively, in FIG. 14. In these figures, the downward direction in the potential means positive values. In a manner similar to FIGS. 13(*a*) to 13(*i*), the channel potentials at the switches 60*a*, 62*a*, 60*b*, 62*b* and the output gate 24 are illustrated by the lines 60*ap*, 62*ap*, 60*bp*, 60*p* and 24*p*. The symbols A, B and C denote the signal charge representing 3-bit image data at the individual pixel, and the levels of data, "L" and "H", direct an existence of the signal charges. The symbol /A, represents a reverse signal of A, and if there is a signal charge in A, for example, there is no signal charge in /A. However, for the convenience of explanation, the signal charge /A is also illustrated hypothetically in the physical existence, as well as signal charges A, B and C, in the figures.

By referring to FIGS. 14 and 15(*a*) to 15(*e*), the drive signal waveforms of the changes in the channel potentials in the BBD for the individual time points (a) to (e) in FIG. 14 will be described. For all of the time points from (a) to (e), the gate line 11 and the data input switch 1 controlled by this line are turned OFF, and the DC voltage is applied to the signal line 12 or the signal line 12 is grounded in order to prevent electric power consumption.

FIG. 15(*a*): This case also corresponds to the state wherein the fourth BBD drive line 67 is OFF and the first, second and third BBD drive lines 64, 65 and 66 are ON, and the reset gate line 35 is ON and the write gate line 31 is OFF, which is equivalent to the state in FIG. 13(*i*) described above. The signal charge C is kept between a couple of potential walls, 60*ap* and 62*ap*. The signal charge A is kept between a couple of potential walls, 62*bp* and 24*p*. The electric potential at the input terminal of the inverter 3 is fixed to be 10V by the reset switch 34, which is controlled by the reset gate line 35.

FIG. 15(*b*): Next, the reset switch 34 is turned off by the reset gate line 35, so that the input terminal of the inverter 3 is floating, and next, as the fourth BBD drive line 67 is turned off, the signal charge A flows over the potential wall 24*p* of the output gate 24 and is supplied to the input terminal of the inverter 3. Since a constant voltage is always applied to the output gate line 25, it should be noted, as described above, that the level of the potential wall 24*p* has a constant value and that the value of the capacitance 23*c* is designed to be approximately twice as large as the value of other BBD capacitances also in this embodiment. As the signal charge A is supplied to the inverter 3, the inverter 3 outputs the inverted signal of A, that is, /A. Its output voltage is 10V when there is a signal charge A with which the input voltage to the inverter 3 is approximately 6V, and its output voltage is 5V when there is not a signal charge A in which the input voltage to the inverter 3 is 10V for the reset state. In the next step, as the rewrite switch 4 is turned on by the rewrite gate line 31, the output voltage of the inverter 3 is applied to the liquid crystal capacitance 5 and the input terminal of the BBD 2, and it is then used for display. As the third BBD drive line 66 is turned on in accordance with there write switch 4 turning on, the signal charge B transfers through the switch 60*b* to the capacitance 61*b* and is kept between a couple of potential walls, 60*bp* and 62*bp*. The time for turning on the rewrite switch 4 and the time for turning on the third BBD drive line 66 may be shifted relatively to each other, or these times may be defined to be exactly identical to each other.

FIG. 15(*c*): Next, the third BBD drive line 66 is turned off, and then, the second BBD drive line 65 is turned on. The signal charge C transfers through the switch 62*a* to the capacitance 63*a* and is kept between a couple of potential walls, 62*ap* and 60*bp*. The signal charge is still kept between a couple of potential walls, 60*bp* and 62*bp*.

FIG. 15(*d*): The second BBD drive line 65 is turned off, and then, the first BBD drive line 64 is turned on. The signal charge /A is supplied from the inverter 3 to the capacitance 61*a* through the rewrite switch 4 and the switch 60*ap*. The signal charge C is still kept between a couple of potential walls 62*ap* and 60*bp*, and the signal charge B is still kept between a couple of potential walls, 60*bp* and 62*bp*.

FIG. 15(*e*): Since the rewrite switch 4 is turned off by the rewrite gate line 31, the liquid crystal capacitance 5 continues to provide a display output corresponding to the signal charge /A until the rewrite switch 4 is turned on next. The first BBD drive line 64 is turned off in accordance with this operation, and the signal charge /A is kept between a couple of potential walls, 60*ap* and 62*ap*. The time for turning off the rewrite gate line 31 and the time for turning off the first BBD drive line 64 may be shifted relatively to each other, or these times may be defined to be exactly identical to each other. Though turning off the first BBD drive line 64 earlier is more advantageous for stabilizing the input charge amount due to the smaller output impedance of the inverter 3, there is no difference if the value of the liquid crystal capacitance 5 is large enough. Next, the fourth BBD drive line 67 is turned off, and the signal charge B transfers through the switch 62*b* to the capacitance 63*b* and is kept between a couple of potential walls 62*bp* and 24*p*. In accordance with this operation, since the reset switch 34 is turned ON by the reset gate line 35, the signal charge A is reset and the input to the inverter 3 returns again to 10V. The time for turning off the fourth BBD drive line 67 and the time for turning on reset gate line 35 may be shifted relatively to each other, or these times may be defined to be exactly identical to each other. This state is such a state that the signal charges are shifted forward by 1-bit from the state shown in FIG. 15(*a*).

In this embodiment, by repeating the operations shown in FIGS. 15(*a*) to 15(*e*), the output for the 3-bit digital image data can be displayed sequentially by the liquid crystal capacitance 5, and a rewrite operation equivalent to the refresh operation of a DRAM can be performed simultaneously inside the pixel, without using a signal line 12 having a large parasitic capacitance and with lower electric power consumption. In this embodiment, every time the rewrite operation of 3-bit data into the liquid crystal capacitance 5 is completed at the end of a single data loop, the voltage applied to the liquid crystal common electrode 36 is inverted. With this operation, an AC drive of the liquid crystal capacitance 5 is realized in a similar manner to embodiment 1.

As for the display operation for 8-level (2 to the power of 3) gray scale images by altering the display periods for three sets of single-bit data so as to increase the display periods to twice as long, such an embodiment is equivalent to the embodiment 1, and thus, those operations are not described again in detail here.

Since the device structures for the individual switches and the BBD, and reflection-type and transmission-type liquid crystal display structures in this embodiment, are equivalent to those in the embodiment 1, they are not described again in detail here.

(Embodiment 3)

Next, an embodiment 3 of the present invention will be described with reference to FIGS. 16 to 19.

The overall configuration and its operations of this embodiment is basically equivalent to those of the embodiment 1 described with reference to FIG. 1, except for inverter ladder to be used as a memory device inside the pixel the structure of the BBD (Bucket Brigade Device) 2 and its drive method. Thus, the overall configuration and its operation are not described in detail, but the pixels and BBD featuring this embodiment will be described. Though the individual pixels can store and hold 4-bit digital image data in this embodiment, this will be described later.

Figure 16:
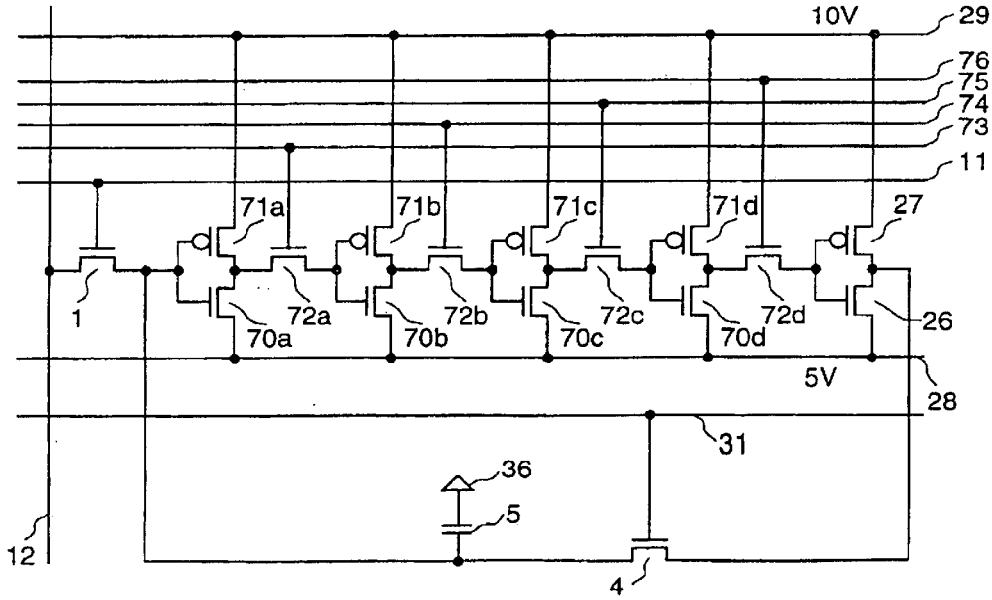
FIG. 16 is a circuit diagram of the pixel in the embodiment 3.
Figure 15A:
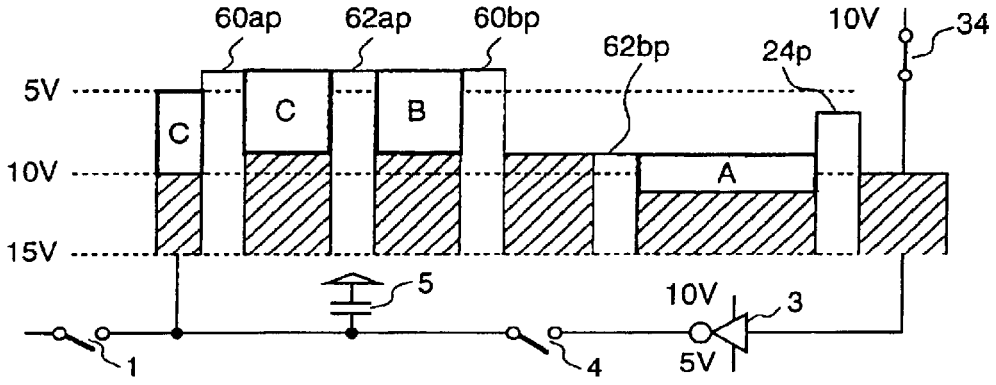
FIGS. 15(*a*) to 15(*e*) are diagrams of potential values at times (a)–(e), respectively, in FIG. 14 when displaying and rewriting image data in the embodiment 2.
Figure 15B:
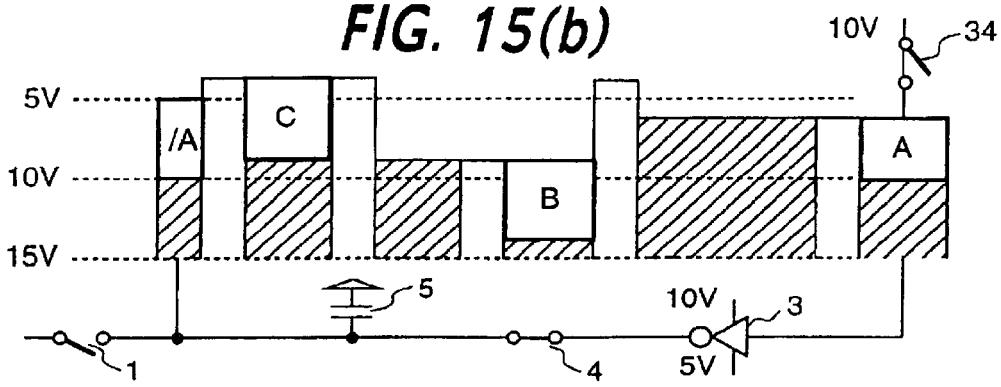
Figure 15C:
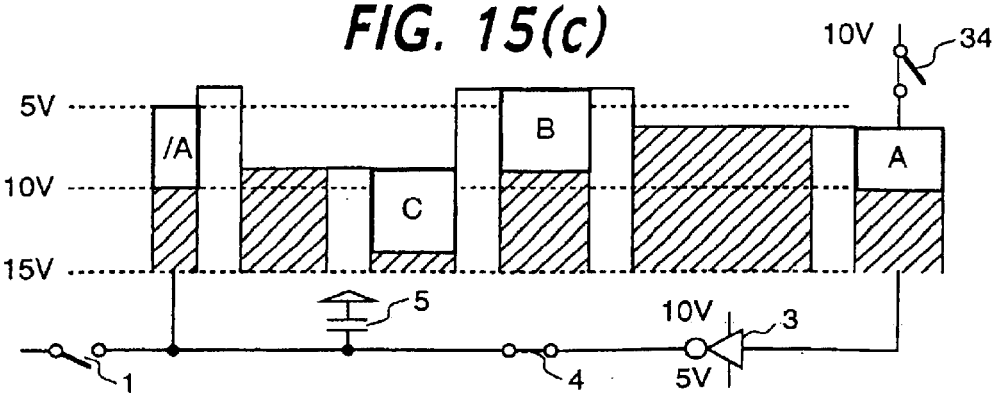
Figure 15D:
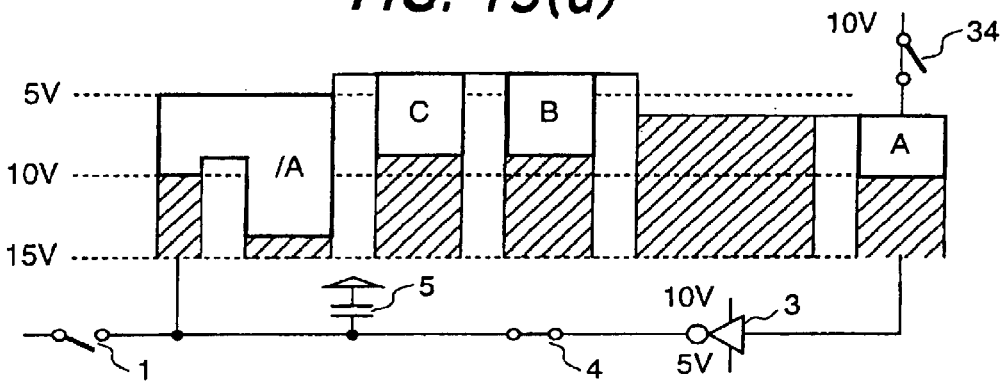
Figure 15E:
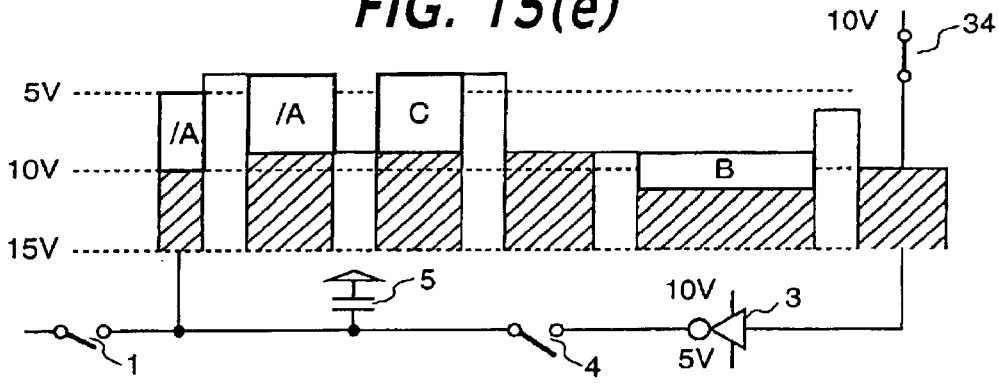

FIG. 16 shows an example of the internal structure of the pixel in this embodiment. A DRAM composed of the data input switch 1 and the liquid crystal capacitance 5 is formed in the pixel, and the terminal of the data input switch 1 is connected to the signal line 12. The component 36 is a liquid crystal common electrode. The data hold node of the DRAM extends to the first inverter stage composed of the PMOS driver 71*a*, the NMOS driver 70*a* and the output switch 72*a*, which is connected to the second inverter stage composed of the PMOS driver 71*b*, the nMOS driver 70*b* and the output switch 72*b*, which is connected to the third inverter stage composed of the pMOS driver 71*c*, the nMOS driver 70*c* and the output switch 72*c*, which is connected to the fourth inverter stage composed of the PMOS driver 71*d*, the nMOS driver 70*d* and the output switch 72*d*. The output of the fourth inverter step is input to the CMOS inverter 3 composed of the pMOS driver 27 and the NMOS driver 26, and its output is input again to the data hold node of the DRAM through the rewrite switch 4 controlled by the rewrite gate line 31. The individual gates of the individual output switches 72*a*, 72*b*, 72*c* and 72*d* are connected to the first stage output switch gate line 73, the second stage output switch gate line 74, the third state output switch gate 75 and the fourth stage output switch gate line 76, respectively. The high-voltage terminals of the individual CMOS inverters are connected to the 10V electric power line 29, and the low-voltage terminals of the individual CMOS inverters are connected to the 5V electric power line 28. In this structure, a series connection of the inverters from the first stage to the fourth stage forms an inverter ladder.

The operation of the pixels in this embodiment will be described. In this embodiment, in the state wherein the inverter ladder is not operated, that is, when the pixel memory is not used, since ordinary multi-value mode display or analog mode display operations are also equivalent to those in the embodiment 1, the details thereof will not be described here. In case where the pixel memory is not used, the rewrite switch 4 may be held in the off state by the write gate line 31, and thus, an identical lower voltage is preferably applied to the electric power line 29 and the 5V electric power line 28 in order to reduce the electric power consumption.

Next, by referring to FIGS. 17 and 18, the operation for writing the 4-bit digital image data into the pixel will be described.

Figure 17:
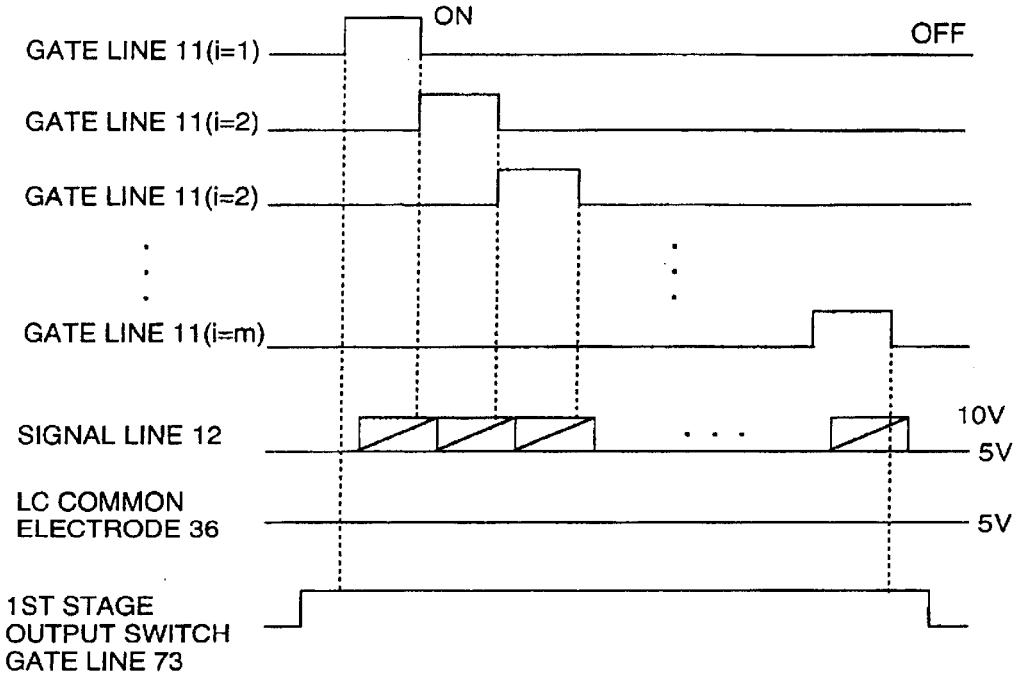
FIG. 17 is a diagram showing drive signal waveforms of signals produced when writing 1-bit pixel data in the embodiment 3.

FIG. 17 shows drive signal waveforms on the gate line 11, arbitrary signal line 12, the liquid crystal common electrode 36, and the first stage output switch gate line 73 when writing the 1-bit digital image data into the overall pixels, in which the number of pixels is assumed to be m rows. In the drawings, the upward direction in the waveform indicates an ON state or high voltage, and the downward direction in the waveform indicates an OFF state or low voltage. For writing 1-bit pixel data, the first stage output switch gate line 73 is turned on at first, and next, the data input switches for the individual rows scanned by the gate line 11 are turned on sequentially. Image data is applied to the signal line 12 with a little delay relative to the drive pulse on the gate line 11. At the end of the above operations, the 1-bit image data for the overall pixels scanned by the gate line is stored in the input capacitance of the second inverter stage composed of the pMOS driver 71*b* and the NMOS driver 70*b* through the first inverter stage composed of the pMOS driver 71*a* and the NMOS driver 70*a*.

The 1-bit data for the individual pixel changes its polarity between "L" and "H" in this embodiment every time when passing through the inverter, which will not be described in detail.

Next, the operation of the pixels when writing the 4-bit digital image data will be described.

Figure 18:
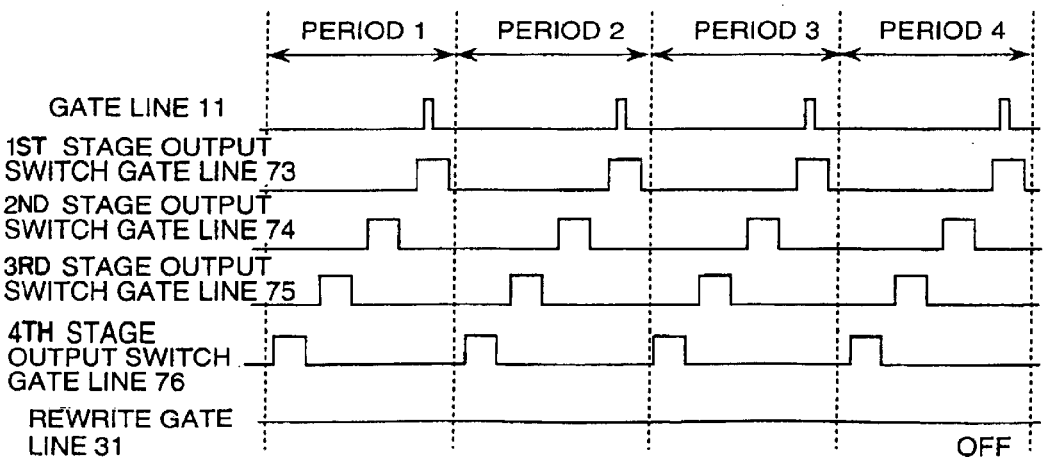
FIG. 18 is a diagram showing drive signal waveforms of signals produced when writing 3-bit pixel data in the embodiment 3.

FIG. 18 shows drive signal waveforms on the arbitrary gate line 11, the first stage output switch gate line 73, the second output switch gate line 74, the third stage output switch gate line 75, the fourth stage output switch gate line 76 and the rewrite gate line 31. When sequentially reading the 4-bit digital pixel data, the rewrite switch 4 is always turned OFF in order to prevent it from being rewritten by the inverter ladder.

The operations for the individual periods 1 to 4 shown in FIG. 20 will be described below.

Period 1: At first, the first 1-bit of digital pixel data is read from the signal line 12 onto the in pixel inverter ladder. For this operation, the individual output switch gate lines 75 and 74 extended out from the fourth stage output switch gate line 76 are turned on and off in advance, and the first stage output switch gate line 73 is turned on and off at the end. The operation of turning on and off the first stage output switch gate line 73 at the end is the operation for writing 1-bit image data into the individual pixels as described with reference to FIG. 17. When repeating the operations of turning on and off the output switch gate lines 76, 75, 74 and 73 at the individual stages, the rest of the output switch gate lines 76, 75, 74 and 73 remain OFF, as shown in the figure. As described before, the 1-bit pixel data for the overall pixels scanned by the gate line is stored in the input capacitance of the second inverter stage composed of the PMOS driver 71*b*, the nMOS driver 70*b* and the output switch 72*b*. The output switch gate lines 76, 75 and 74 at the individual stages are turned on and off sequentially starting from the fourth stage output switch gate line 76 before turning on and off the first stage output switch gate line, which is designed to provide for simplification of drive signal waveform formation logic by defining regularly the drive signal waveforms on the individual output switch gate lines 76, 75, 74 and 73. It is apparent that such additional signal drives can be omitted in practice.

Period 2: Next, in the similar manner to the previous case, when the output switch gate lines 76, 75, 74 and 73 of the individual stages are turned on and off repetitively, the first 1-bit data stored in the input capacitance of the second inverter stage composed of the pMOS driver 71*b*, the nMOS driver 70*b* and the output switch 72*b* is transferred to and stored in the input capacitances of the third inverter stage composed of the pMOS driver 71*c*, the nMOS driver 70*c* and the output switch 72*c*. In the end, when the first stage output switch gate line 73 is turned on and off, the second bit of the data is transferred through the data input switch 1 driven by the gate line to the signal line 12, and then it is stored in the input capacitance of the second inverter stage composed of the PMOS driver 71*b*, the nMOS driver 70*b* and the output switch 72*b*.

Period 3: Also, in a similar manner to the previous cases, when the output switch gate lines 76, 75, 74 and 73 of the individual stages are turned on and off repetitively, the first 1-bit data stored in the input capacitance of the third inverter stage composed of the pMOS driver 71*c*, the nMOS driver 70*c* and the output switch 72*c* is transferred to and stored in the input capacitance of the fourth inverter stage composed of the pMOS driver 71*d*, the nMOS driver 70*d* and the output switch 72*d*. The second 1-bit data stored in the input capacitance of the second inverter stage composed of the PMOS driver 71*b*, the nMOS driver 70*b* and the output switch 72*b* is transferred to and stored in the input capacitance of the third inverter stage composed of the PMOS driver 71*c*, the nMOS driver 70*c* and the output switch 72*c*. In the end, when the first stage output switch gate line 73 is turned on and off, the third bit of the data is transferred through the data input switch 1 driven by the gate line to the signal line 11, and it is then stored in the input capacitance of the second inverter stage composed of the pMOS driver 71*b*, the nMOS driver 70*b* and the output switch 72*b*.

Period 4: Finally, in a similar manner to the previous cases, wherein the output switch gate lines 76, 75, 74 and 73 of the individual stages are turned on and off repetitively, the first 1-bit data stored in the input capacitance of the fourth inverter stage composed of the pMOS driver 71*d*, the nMOS driver 70*d* and the output switch 72*d* is transferred to and stored in the input capacitance of the inverter 3 composed of the pMOS driver 27 and this nMOS driver 26. The second 1-bit data stored in the input capacitance of the third inverter stage composed of the pMOS driver 71*c*, the nMOS driver 70*c* and the output switch 72*c* is transferred to and stored in the input capacitance of the fourth inverter stage composed of the pMOS driver 71*d*, the nMOS driver 70*d* and the output switch 72*d*. The third 1-bit data stored in the input capacitance of the second inverter stage composed of the pMOS driver 71*b*, the nMOS driver 70*b* and the output switch 72*b* is transferred to and stored in the input capacitance of the third inverter stage composed of the PMOS driver 71*c*, the nMOS driver 70*c* and the output switch 72*c*. In the end, the fourth bit of the data is transferred through the data input switch 1 driven by the gate line 11 to the signal line 12, and it is then stored in the input capacitance of the second inverter stage composed of the pMOS driver 71*b*, the nMOS driver 70*b* and the output switch 72*b*. Thus, reading 4-bit digital pixel data is completed at the end of the above described operations. In those operations, the individual 1-bit data is held in the input capacitance of the individual inverter. By forming an additional capacitance at the input terminal of the individual inverter, if required, the data hold characteristic at the pixel can be made stable as a trade off with the increase in the area occupied by the circuit.

Figure 19:
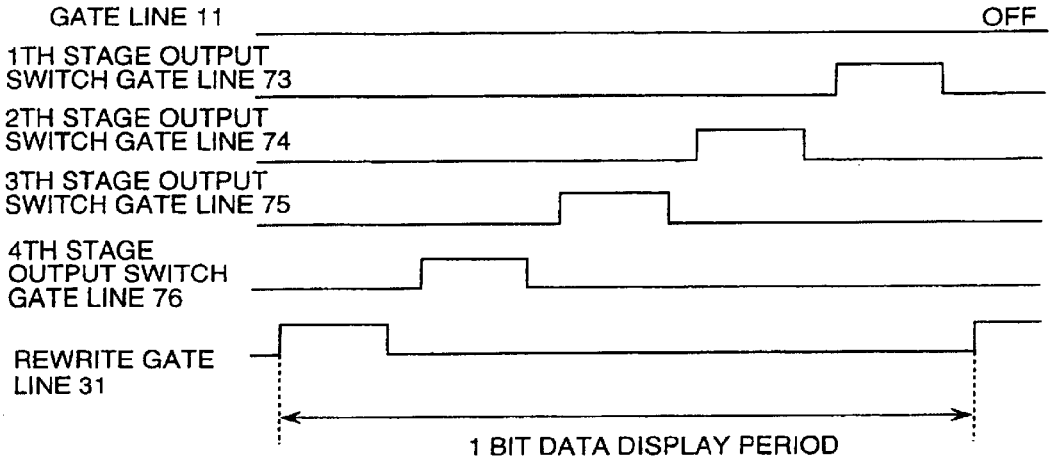
FIG. 19 is a diagram showing drive signal waveforms of signals produced when displaying and rewriting image data in the embodiment 3.

Next, the operations for displaying and rewriting 4-bit digital image data at the pixels will be described with reference to FIG. 19. FIG. 19 shows drive signal waveforms on the arbitrary gate line 11, arbitrary signal line 12, the first stage output switch gate line 73, the second stage output switch gate line 74, the third stage output switch gate line 75, the fourth stage output switch gate line 76 and the rewrite gate line 31 when displaying and rewriting 4-bit digital image data at the pixel. When displaying and rewriting 4-bit digital image data, the gate line 11 and the data input switch 1 controlled by this are turned OFF, and a DC voltage is applied to the signal line 12 or the signal line 12 is grounded in order to prevent electric power consumption.

At first, the rewrite switch 4 is turned on and off by the rewrite gate line 31. With this operation, the first 1-bit data stored in the input capacitance of the inverter 3 composed of the pMOS driver 27 and the nMOS driver 26 is transferred to the liquid crystal capacitance 5, where it is stored and displayed. At the same time, this data is also stored in the input capacitance of the first inverter stage composed of the PMOS driver 71*a*, the nMOS driver 70*a* and the output switch 72*a*. It should be noted that the first 1-bit data is reversed with respect to the data input at first, when this data is input again into the input capacitance of the first inverter stage. This means that the polarity of the data in terms of "L" and "H" changes. This is due to an existence of an odd number (5 stages) of inverters in the data rewrite loop of the memory.

Next, when the fourth stage output switch gate line 76 turns on and off, the second bit of the data stored in the input capacitance of the fourth inverter stage composed of the PMOS driver 71*d*, the nMOS driver 70*d* and the output switch 72*d* is transferred to and stored in the input capacitance of the inverter 3 composed of the pMOS driver 27 and the nMOS driver 26.

Next, when the third stage output switch gate line 75 turns on and off, the third bit of the data stored in the input capacitance of the third inverter stage composed of the PMOS driver 71*c*, the nMOS driver 70*c* and the output switch 72*c* is transferred to and stored in the input capacitance of the fourth inverter stage composed of the pMOS driver 71*d*, the NMOS driver 70*d* and the output switch 72*d*.

Next, when the second stage output switch gate line 74 turns on and off the fourth bit of the data stored in the input capacitance of the second inverter stage composed of the pMOS driver 71*b*, the nMOS driver 70*b* and the output switch 72*b* is transferred to and stored in the input capacitance of the third inverter stage composed of the pMOS driver 71*c*, the nMOS driver 70*c* and the output switch 72*c*.

Finally, the first stage output switch gate line 73 turns on and off, the first inverted bit of the data stored in the input capacitance of the first inverter stage composed of the pMOS driver 71, the nMOS driver 70*a* and the output switch 72*a* is transferred again to and stored again in the input capacitance of the second inverter stage composed of the pMOS driver 71*b*, the nMOS driver 70*b* and the output switch 72*b*.

In this embodiment, by repeating the above operations, the output for the 4-bit digital pixel data can be displayed sequentially, and a rewrite operation equivalent to the refresh operation of a DRAM can be performed simultaneously inside the pixel without using signal a line 12 having a large parasitic capacitance and with lower electric power consumption. In this embodiment, every time the rewrite operation of 4-bit data into the liquid crystal capacitance 5 is completed at the end of a single data loop, the voltage applied to the liquid crystal common electrode 36 is inverted. With this operation, an AC drive of the liquid crystal capacitance 5 is realized in the same manner as described with reference to FIG. 1.

This embodiment also has the same architecture as the embodiment 1, in which a 16-level (2 to the power of 4) gray scale image display can be established by altering the display periods for four sets of single-bit data so that the periods are twice as long, and reflection-type and transmission-type liquid crystal displays are used similarly, which will not be described again here.

Though the individual transistors in this embodiment use poly-Si TFT as in the embodiment 1, since this embodiment does not require a BBD, there is an advantage in that the impurity doping process for forming capacitances can be omitted.

Though this embodiment assumes that 4-bit image data is used for display, the structure in this embodiment can be applied to another bit length for the image data. In case of applying this structure to another bit length other than 4-bit image data, it is required to add or remove appropriately an inverter circuit for effecting the inversion of data. For example, if an inversion drive is not considered also in this embodiment, the inverter circuit composed of the pMOS driver 71*a* and the NMOS driver 70*a* can be omitted, and thus, the inverter circuit having the individual pixel can be designed to be configured in three stages if 3-bit image data is processed.

(Embodiment 4)

Figure 21:
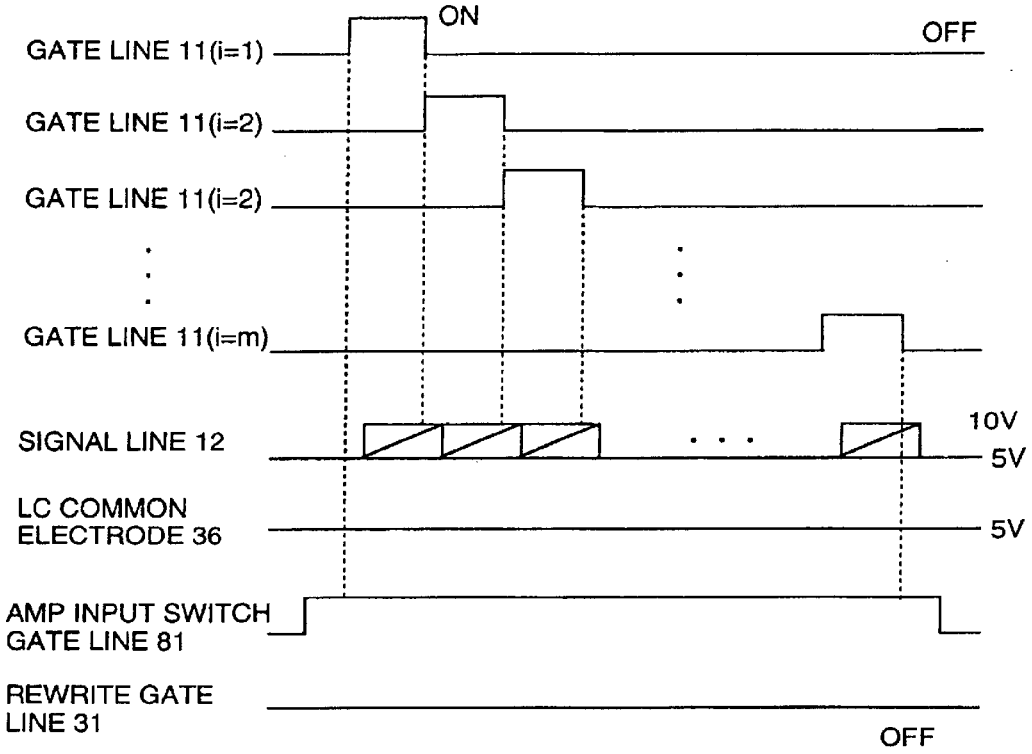
FIG. 21 is a diagram showing drive signal waveforms of signals produced when writing 1-bit pixel data in the embodiment 4.
Figure 22:
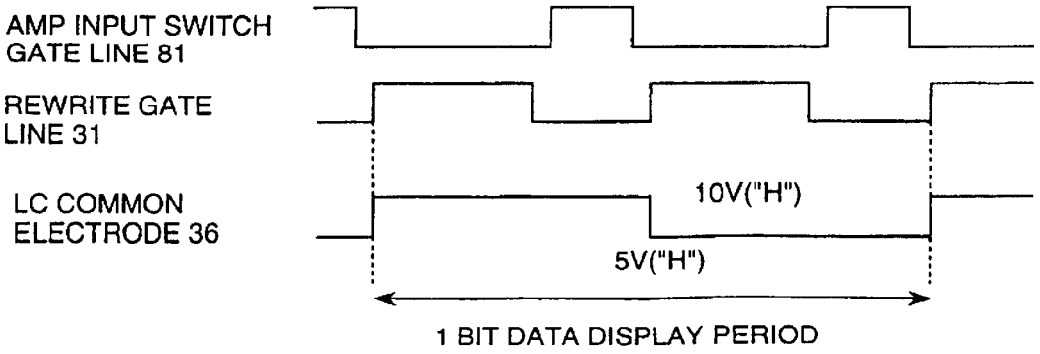
FIG. 22 is a diagram showing drive signal waveforms of signals produced when displaying and rewriting image data in the embodiment 4.

By referring to FIGS. 20 to 22, an embodiment 4 of the present invention will be described. This embodiment is equivalent to the configuration used in the embodiments in which the data length of the image data stored in the pixel is formed as 1-bit. The overall structure and its operations are identical to those in the embodiment 1 described with reference to FIG. 1, excluding the fact that switches are used as memory devices instead of a BBD (Bucket Brigate Device) 2. Thus, the overall structure and its operations will not be described here, but the pixel featuring this embodiment will be described below.

Figure 20:
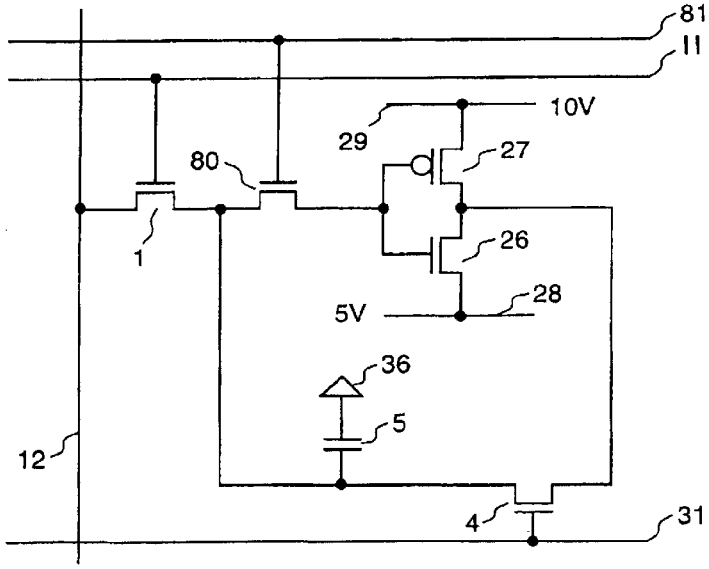
FIG. 20 is a circuit diagram of the pixel in the embodiment 4.

FIG. 20 shows an example of the internal structure of the pixel in this embodiment. A DRAM composed of the data input switch 1 and the liquid crystal capacitance 5 is formed in the pixel, and the terminal of the data input switch 1 is connected to the signal line 12. The component 36 is a liquid crystal common electrode. The data hold node of the DRAM is input through the amplifier input switch 80 to the CMOS inverter 3 composed of the pMOS driver 27 and the nMOS driver 26, and its output is input again to the data hold node of the DRAM through the rewrite switch 4. The gate of the amplifier input switch 80 is connected to the amplifier input switch gate line 81. The high-voltage terminals of the individual CMOS inverters are connected to the 10V electric power line 29, and the low-voltage terminals of the individual CMOS inverters are connected to the 5V electric power line 28.

The operation of the pixels in this embodiment will be described. In this embodiment, in the state in which the inverter 3 is not operated, that is, where the pixel memory is not used, since ordinary multi-value mode display or analog mode display operations are also equivalent to those in the embodiment, the details thereof will not be described here. In case in which the pixel memory is not used, the rewrite switch 4 may be held in the off state by the write gate line 31, and thus, an identical lower voltage is preferably applied to the electric power line 29 and the 5V electric power line 28 in order to reduce the electric power consumption.

Next, by referring to FIG. 21, the (refresh) operation for writing the 1-bit digital image data into the pixel will be described. FIG. 21 shows drive signal waveforms on the gate line 11, arbitrary signal line 12, the liquid crystal common electrode 36, and the amplifier input switch gate line 81 when writing the 1-bit digital image data into the overall pixels, in which the number of pixels is assumed to be m rows. In the individual drawings, the upward direction in the waveform indicates an ON state or high voltage, and the downward direction in the waveform indicates an OFF state or low voltage. For writing 1-bit pixel data, the first stage output switch gate line 73 is turned on at first, and next, the data input switches for the individual rows scanned by the gate line 11 are turned on sequentially. Image data are put into the signal line 12 with a little delay relative to the drive pulse on the gate line 11. At the end of the above operations, the 1-bit image data for the overall pixels scanned by the gate line is input through the amplifier input switch 80 to the CMOS inverter 3 composed of the pMOS driver 27 and the nMOS driver 26 and stored into its input capacitance. The liquid crystal common electrode 36 is kept in a constant voltage, and the rewrite gate line 31 keep the rewrite switch 4 off, thereby to disable the rewrite operation by the CMOS inverter 3.

The 1-bit data for the individual pixel changes its polarity between "L" and "H" in this embodiment every time it passes through the inverter, which will not be described in detail. The 1-bit image data is held in the input capacitance of the CMOS inverter 3, in other words, the amplifier input switch 80 and the input capacitance of the CMOS inverter 3 form another DRAM. By forming additional capacitances at the input terminals of the individual inverters, the data hold characteristic at the pixel can be made stable as a trade off with the increase in the area occupied by the circuit.

Next, the operations for displaying and rewriting 1-bit digital image data at the pixels will be described with reference to FIG. 22. FIG. 22 shows drive signal waveforms on the amplifier input switch gate line 81, the rewrite gate line 31 and the liquid crystal common electrode 36 when displaying and rewriting 1-bit digital image data at the pixel. When displaying and rewriting 1-bit digital image data, the gate line 11 and the data input switch 1 controlled by this are turned OFF, and DC voltage is applied to the signal line 12 or the signal line 12 is grounded in order to prevent the electric power consumption.

At first, the amplifier input switch 80 is turned OFF by the amplifier input switch gate line 81, and this signal waveform is identical to the signal waveform when the data is written in the pixel, as described with reference to FIG. 21. Next, the rewrite switch 4 is turned on and off by the rewrite gate line 31, and in accordance with this operation, the polarity of the liquid crystal common electrode 36 changes its value from "L" to "H". The 1-bit data stored in the input capacitance of the inverter 3 composed of the PMOS driver 27 and the nMOS driver 26 is transferred to the liquid crystal capacitance 5 and stored there, to be used for display. It should be noted here that the 1-bit data at this point is an inversion of the data initially input into the pixel, that is, its polarity "L" or "H" is altered.

Next, when the amplifier input switch gate line 81 turns on and off, the 1-bit inverted pixel data stored in the liquid crystal capacitance 5 is transferred again to and stored in the input capacitance of the inverter 3 composed of the pMOS driver 27 and the nMOS driver 26.

Next, the rewrite switch 4 is turned on and off by the rewrite gate line 31, and in accordance with this operation, the polarity of the liquid crystal common electrode 36 changes to the "L" level. Then, the 1-bit inverted pixel data stored in the liquid crystal capacitance 5 is transferred again to and stored in the input capacitance of the inverter 3 composed of the pMOS driver 27 and the nMOS driver 26, and is used for display. It should be noted again here that the 1-bit data at this point is identical to the data initially input into the pixel, that is, its polarity "L" or "H" returns to the original state. Since the liquid crystal common electrode 36 is inverted again here, it can be recognized that AC voltage drive of the liquid crystal is established.

After that, when the amplifier input switch gate line 81 turns on and off, the 1-bit pixel data stored in the liquid crystal capacitance 5 is transferred to and stored in the input capacitance of the inverter 3 composed of the pMOS driver 27 and the nMOS driver 26.

In this embodiment, by repeating the above operations, the rewrite operation equivalent to a DRAM refresh operation along with the inversion and display operation for the output corresponding to the 1-bit image data can be performed without using a signal line 12 having a large parasitic capacitance and with lower electric power consumption.

Figure 29:
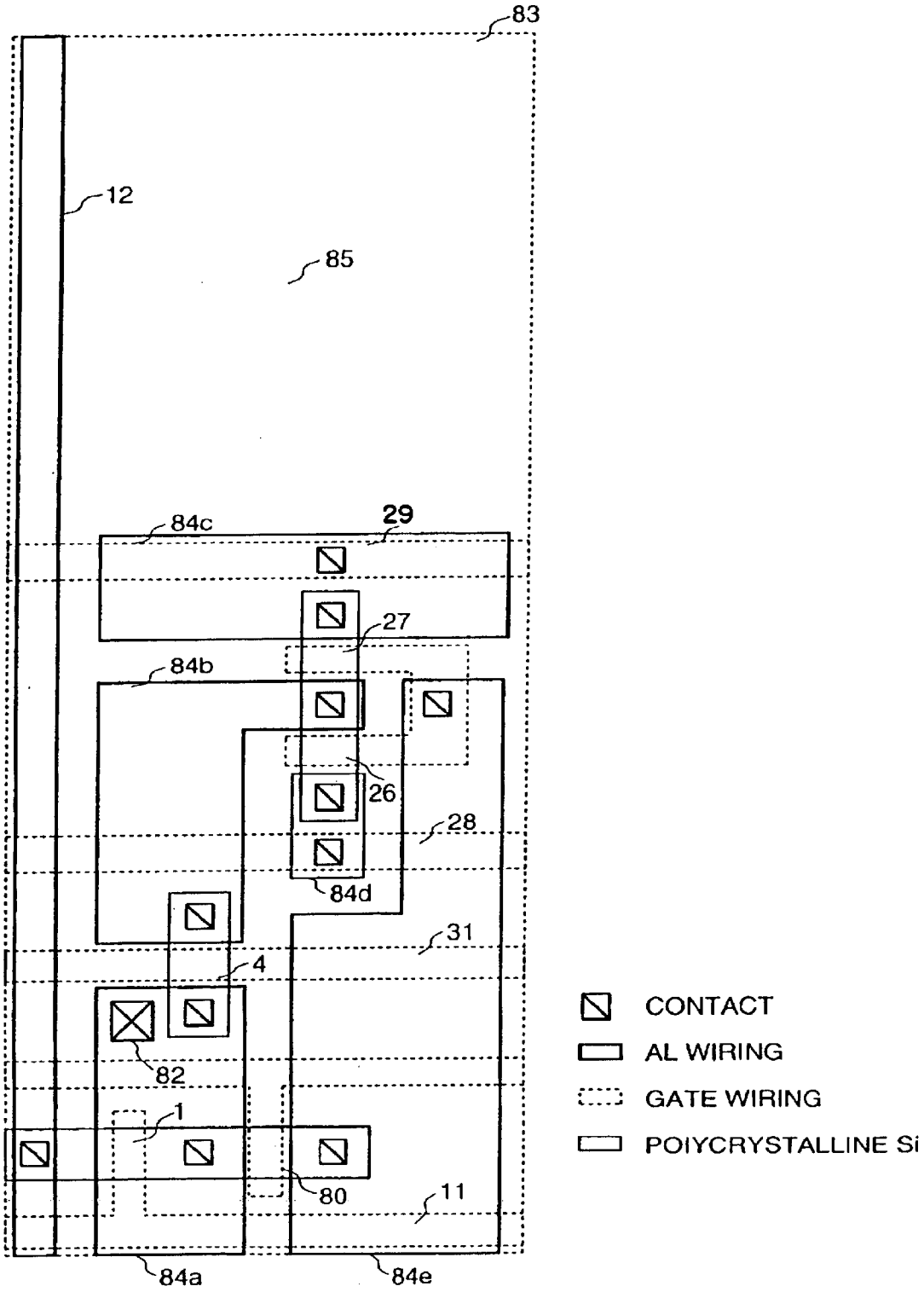
FIG. 29 is a plane view of the pixel in the embodiment 4.

In this embodiment, a partial transmission-type liquid crystal display structure providing both reflection-type and transmission-type image displays is employed. This structure will be described with reference to FIG. 29, which is a plan view of the pixel 83 in this embodiment, showing a layout including polycrystalline Si islands, gate wirings, Al wiring layers and contact holes.

The signal line 12 wired with Al is input to the Al reflecting electrode 84*e* through the data input switch 1 with agate electrode formed by the gate line 11 and the amplifier input switch 80 with a gate electrode formed by the amplifier input switch gate line 81. The Al reflecting electrode 84*e* is connected to the gate electrodes of the pMOS driver 27 and the nMOS driver 26, and the pMOS driver 27 and the nMOS driver 26 are connected to the 10V electric power line 29 and the 5V electric power line 28, each composed of the gate wiring layers, respectively, through the Al reflecting electrode 84*c* and the Al reflecting electrode 84*d*. The output of the CMOS inverter composed of the pMOS driver 27 and the nMOS driver 26 is input through the Al reflecting electrode 84*b* to the rewrite switch 4 having a gate electrode formed by the rewrite gate line 31*a*, and its output is coupled to the output of the data input switch 1 through the Al reflecting electrode 84*a*. The Al reflecting electrode 84*a* has an ITO contact 82, which is connected to the liquid crystal electrode 5 through the ITO electrode (not shown in the figure) covering the overall pixel 83.

The electrical operation of the pixel is as described with reference to FIG. 20, and thus, the optical structure of the pixel will now be described. Since the Al reflecting electrodes 84*a*, 84*b*, 84*c*, 84*d* and 84*e* covering the pixel 83 are provided so as to reflect the incident light from the outside, this embodiment can provide a reflection-type liquid crystal display which is established only with external light. The region 85 which excludes the Al reflecting electrodes 84*a*, 84*b*, 84*c*, 84*d* and 84*e* and the signal line 12 is an open port for transmitting the backlight formed behind the liquid crystal display panel through the whole area of the panel. In this embodiment, since the scale of the circuit for adding the memory function to the pixel is small, there is an advantage in that an open port of sufficient size can be obtained for providing such a transmission-type liquid crystal display. In this embodiment, the size of the pixel is 252 m×84 m, which establishes a 30% or more transmission aperture even with a layout rule using a minimum dimension of 84 m.

Though the individual transistors in this embodiment use poly-Si TFT as in the embodiment 1, since this embodiment does not require a BBD, there is an advantage in that the impurity doping process for forming capacitances can be omitted.

Though the amplifier input switch 80 is installed between the inverter 3 and the data input switch 1 in this embodiment, the amplifier input switch 80 may be installed between the liquid crystal capacitance 5 and the data input switch 1. This modification means that the position of the node to which the data is input is changed for a designated data loop. It is possible to apply the same kind of modification in the circuit structure as described above and various kinds of modification in the circuit structure also to other embodiments.

Though the period of time during which the rewrite switch 4 is kept ON is defined to be longer than the period of time during which the amplifier input switch 80 is kept ON in this embodiment, this period of time can be modified accordingly. For example, it is preferable from the point of view of design to determine the period of time during which the individual switch is ON by comparing the time constant for holding a charge in the liquid crystal, capacitance 5 and the time constant for holding a charge in the input capacitance of the inverter 3. As the frame frequency is reduced, the flicker becomes more pronounced due to AC drive of the liquid crystal also in this embodiment, as in other embodiments. However, since a reduction in the frame frequency tends to reduce the electric power consumption, an optimum frame frequency should be properly determined for the application or its usage.

(Embodiment 5)

By referring to FIGS. 23 and 24, an embodiment 5 of the present invention will be described.

Figure 28:
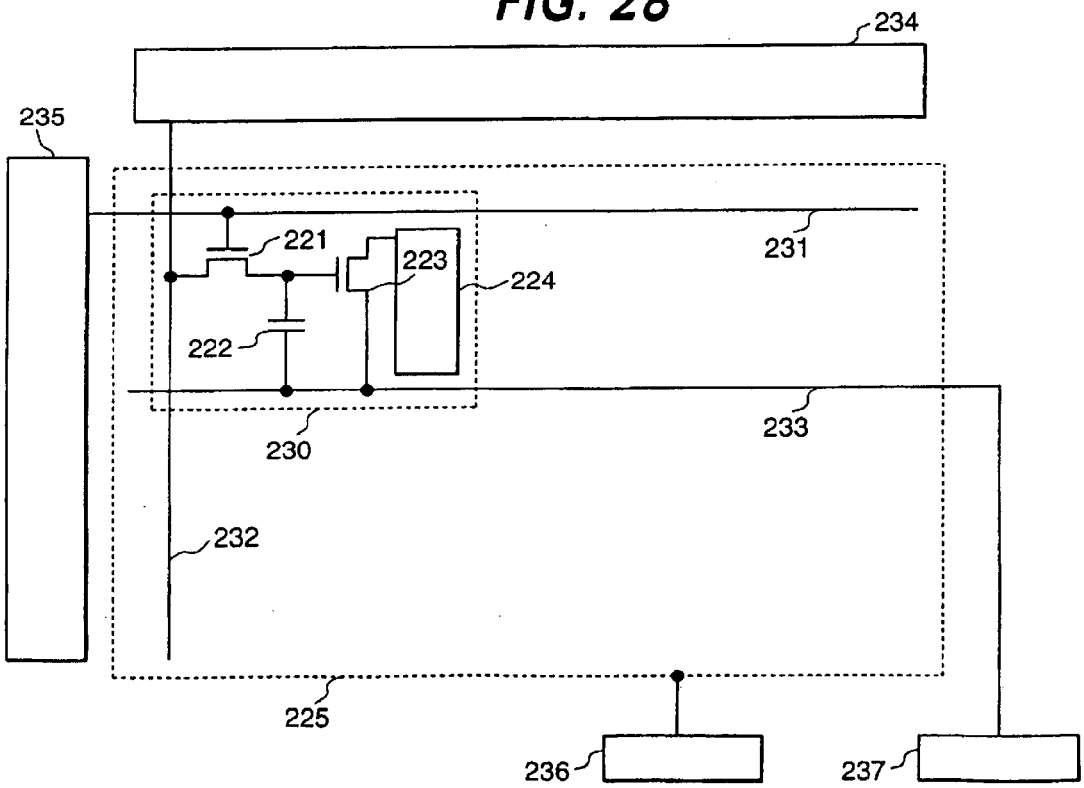
FIG. 28 is a diagram of a known TFT liquid crystal display panel.

The basic structure and its operation in this embodiment is similar to the structure and its in the known display panel described with reference to FIG. 28. The specific difference in this embodiment from the structure described with reference to FIG. 28 is that the individual pixel has a structure such that the individual pixel can refresh the 1-bit image data in the pixel without using the signal line. Thus, the overall structure and its operations will not be described here, but the pixel featuring this embodiment will be described.

Figure 23:
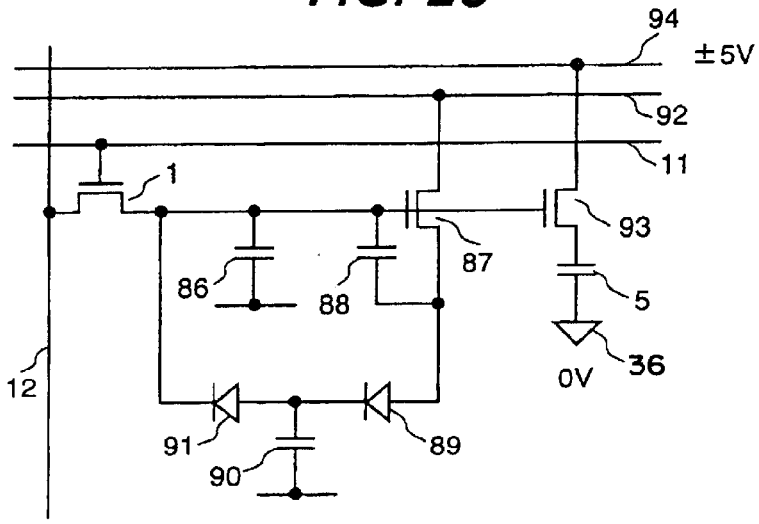
FIG. 23 is a circuit diagram of the pixel in the embodiment 5.

FIG. 23 shows an example of the internal structure of the pixel in this embodiment. A DRAM composed of the data input switch 1 and the hold capacitance 86 is formed in the pixel, and the terminal of the data input switch 1 is connected to the signal line 12. This data node is connected to the gate of the pixel drive switch 93, and the one terminal of the liquid crystal capacitance 5 is connected to the opposed electrode 96, and the other terminal is connected to the common electrode 94 through the pixel drive switch 93. This structure is identical to that used in the display panel described with reference to FIG. 28. This embodiment has the following structure in addition. The data node described above is further connected to the gate of the rewrite switch 8, and the drain of the rewrite switch 87 is connected to the rewrite switch drain line 92. The source of the rewrite switch 87 is fed back to the data node again via the first rewrite diode 89, the rewrite capacitance 90 and the second rewrite diode 91. A bootstrap capacitance 88 is installed between the data node and the source of the rewrite switch 87.

Now, the operation in the known pixel arrangement will be described. When the gate line 11 opens and closes the data input switch 17, the 1-bit image data on the signal line 12 is input to the DRAM composed of the data input switch 1 and the hold capacitance 86 corresponding to a designated pixel row. The pixel drive switch 93 is held in the ON or OFF state in response to the image data written in the DRAM. As AC voltage is applied to the opposed electrode 96, and a designated voltage is applied to the common electrode line 94, AC voltage is applied to the liquid crystal capacitance 5 in the case where the pixel drive switch 93 is turned on, otherwise no voltage is applied to the liquid crystal capacitance 5 in the case where the pixel drive switch 93 is turned off. According to this operation, even if the scanning operation of the gate line 11 and the data output operation to the signal line 12 are interrupted, the liquid crystal display panel can continue to display the 1-bit image data until the data in the DRAM is lost due to leakage current. Those operations so far are the same as the operations described with reference to FIG. 28.

In this embodiment, the following operations makes it possible for the individual pixel to refresh the 1-bit image data within the pixel without using the signal line. Those operations will be described with reference to FIG. 24.

Figure 24:
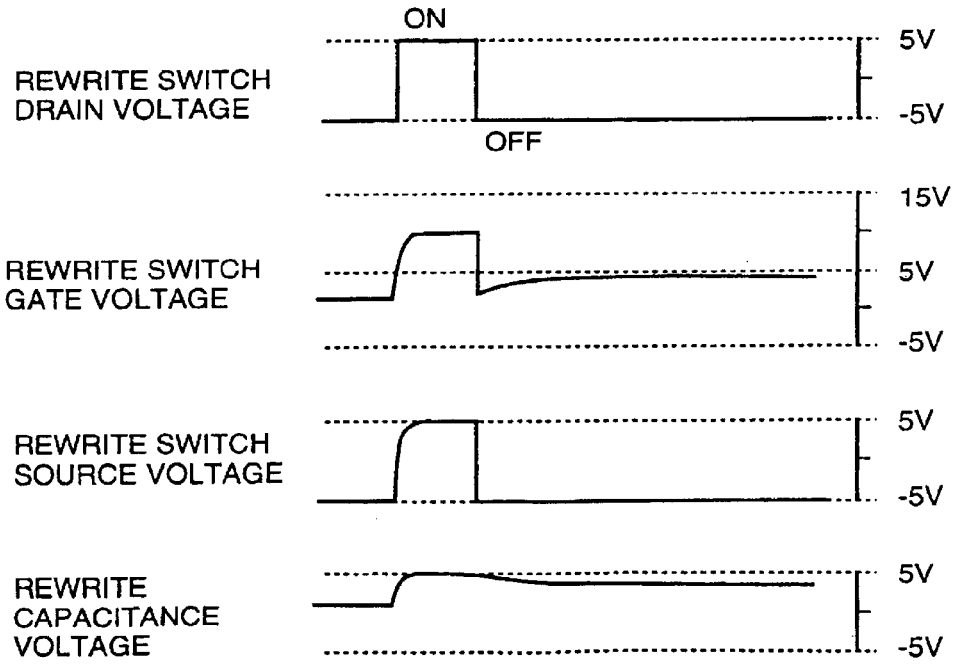
FIG. 24 is a diagram showing terminal voltage waveforms in the refresh operation in the embodiment 5.

FIG. 24 shows voltage signal waveforms on the drain, gate and source of the rewrite switch 87 and a voltage signal waveform on the terminal of the rewrite capacitance 90 to which the rewrite diode is connected in the refresh operation described above. In the refresh operation, a positive pulse is applied to the rewrite switch drain, line 92. This voltage is applied straightforwardly to the drain of the rewrite switch 87, in which the gate voltage of the rewrite switch 87 is −5V if the stored data in the DRAM is "L", and thus, the rewire switch 87 never turns on and the voltage in the pixel does not change (not shown in the figure). However, when the stored data in DRAM is "H", the gate voltage of the rewrite switch 87 is +5V. In practice, though it is assumed that the gate voltage is reduced down to approximately +2V due to leakage in the DRAM, the rewrite switch 87 is turned on and the source voltage rises up to 5V like the drain voltage even in this case, as shown in the figure. This is because the gate voltage rises up approximately to 10V due to the bootstrap capacitance 88 formed between the source and the gate. At this time, the voltage of the rewrite capacitance 90 shown in the figure rises up approximately to 5V. This is because the first rewrite diode 89 is connected in the forward direction between the rewrite capacitance 90 and the source of the rewrite switch 87, in which the rewrite capacitance 90 is charged up until its voltage becomes almost 5V. At this time, a backward voltage is applied to the second rewrite diode 9, and the charge leakage from the memory node of the DRAM to the second rewrite diode 91 can be negligible.

After that, the voltage of the pulse on the rewrite switch drain line 92 returns to −5V. This voltage is applied straightforwardly to the drain of the rewrite switch 87, in which the gate voltage of the rewrite switch 87 is −5V if the stored data in the DRAM is "L", and thus, the rewrite switch 87 never turns on and the voltage in the pixel does not change (not shown in the figure). However, in case the data stored in the DRAM is "H", as described above, the gate voltage of the rewrite switch 87 turns back to −5V and the source voltage turn back to the drain voltage −5V as the gate is ON. The voltage of the rewrite capacitance 90 shown in the figure rises up approximately to 5V, and its charge flows into the gate terminal of the rewrite switch 87 as the memory node of the DRAM. This is because the second rewrite diode 91 connected between the rewrite capacitance 90 charged up to 5V and the gate of the rewrite switch 87 is biased forwardly with the voltage of the rewrite capacitance 90, 5V, and the gate voltage of the rewrite switch 87, +2V, and this charge injection continues until the voltage of the rewrite capacitance 90 and the voltage of the gate of the rewrite switch 87 are identical to each other. This charge injection occurs consequently when the gate voltage of the rewrite switch 87 with its level being "H" is 5V or less, which is equivalent to the refresh operation of a DRAM in this embodiment. At this time, a backward voltage is applied to the first rewrite diode 89, and the charge leakage from the rewrite capacitance 90 to the rewrite switch drain line 92 can be negligible. In this embodiment, by applying a pulsed voltage to the rewrite switch drain line 92 at a designated timing, a rewrite operation equivalent to a DRAM refresh operation can be performed, without using a signal line 12 having a large parasitic capacitance and with lower electric power consumption.

Since the reflection-type and transmission-type liquid crystal display structures in this embodiment are equivalent to those in the embodiment 1, they will not be described again in detail here.

Though the rewrite switch drain line 92 is commonly connected to all the pixels in this embodiment, when this line is shared by the line or column of pixels, the peak electric power consumption for the refresh operation can be reduced by trading off the increases in the complexity of the drive circuit.

The individual transistor in this embodiment is formed by poly-Si TFT similarly to the embodiment 1, in which the first rewrite diode 89 and the second rewrite diode 91 are formed by poly-Si with n+/i/p+ lateral conjunction in order to avoid an unnecessary increase in the number of fabrication processes. In this embodiment, though diode devices are used in order to transfer the signal charge for a rewrite operation in one direction, those devices may be formed by TFT switches driven with adequate drive signal pulses. In this alternative case, though the complexity in the pixel increases because designated drive signals are required to be applied to those TFT switches, the fabrication process can be simplified by forming pixels only with TFT alone.

In this embodiment, how to apply the grounded voltage to the counter electrodes for the hold capacitance 86 and the rewrite capacitance 90 is not described explicitly. This is because this method of applying the grounded voltage is not essential to the spirit of the present invention, but it is obvious that several implementations can be adopted for this method, including a common wiring used for applying the grounded voltage, a usage of gate lines 11 at the adjacent pixel rows and so forth.

(Embodiment 6)

By referring to FIG. 25, an embodiment 6 of the present invention will be described.

The structure and its operation of this embodiment are almost identical to those in the embodiment 3 described with reference to FIGS. 16 to 18, excluding such features as the number of stages in the inverter ladder is one less than the number of stages in the embodiment 3, the length of the pixel data to be stored is 3-bit, and including the feature that a luminescence drive switch 96, a luminescence device 97 and a low voltage electric power line 98 and a high voltage electric power line 99 for supplying luminescence current to this device are installed instead of the liquid crystal capacitance 5 and the liquid crystal common electrode 36. Thus, the overall structure and its operations will not be described here, but the pixel will be described by focusing on the luminescence device 97 featuring this embodiment.

Figure 25:
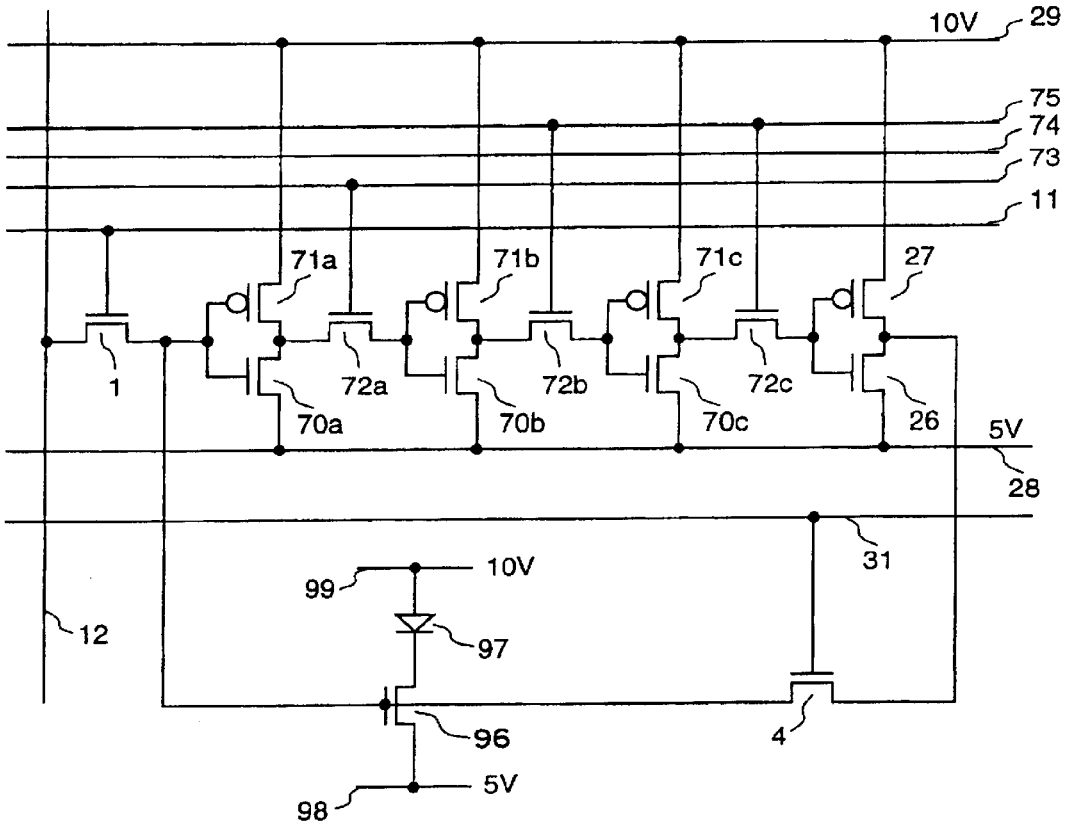
FIG. 25 is a circuit diagram of the pixel in the embodiment 6.

FIG. 25 shows an example of the internal structure of the pixel in this embodiment.

The, pixel has the data input switch 1 and a DRAM composed of the gate capacitance of the luminescence drive switch 96, and the terminal of the data input switch 1 is connected to the signal line 12. The data hold node of the DRAM extends to the first inverter stage composed of the pMOS driver 71*a*, the NMOS driver 70*a* and the output switch 72*a*, the second inverter stage composed of the pMOS driver 71*b*, the nMOS driver 70*b* and the output switch 72*b*, and the third inverter stage composed of the PMOS driver 71*c*, the nMOS driver 70*c*, and the output switch 72*c*, the output of which is input to the CMOS inverter 3 composed of the pMOS driver 27 and the nMOS driver 26; and then, its output is input again to the data hold node of DRAM through the rewrite switch 4 driven by the rewrite gate line 31. The individual gates of the output switches 72*a*, 72*b* and 72*c* are connected to the first stage output switch gate line 73, the second stage output switch gate line 74 and the third stage output switch gate line 75, respectively. The high voltage terminals of the individual CMOS inverters are connected to the 10V electric power line 29 and the low voltage terminals of the individual CMOS inverters are connected to the 5V electric power line 28. And furthermore, in this embodiment, the source of the luminescence drive switch 96 is connected to the low voltage electric power line 98, and the drain of the luminescence drive switch 96 is connected through the luminescence device 97 to the high voltage electric power line 99. As the voltage 5V is applied to the low voltage electric power line 98 and the voltage 10V is applied to the high voltage electric power line 99, those electric power lines are connected to the 5V electric power line 28 and the 10V electric power line 29, respectively, which connections are not shown in the figure for simplification.

The operations of the pixel in this embodiment will be described. Also in this embodiment, in the state in which the inverter ladder is made not operated, that is, when the pixel memory is not used, the ordinary multi-valued display or analog display operations are the same as those in the embodiment 3, which will not be explained again here. As luminescence devices 97 are used for display in this embodiment, there is no need for AC drive of the data, as used in the embodiment 3. As for writing, displaying and rewriting operations of 3-bit digital image data for the pixel, those operations are identical to those in the embodiment 3 excluding the fact that the data length is 3-bit.

In this embodiment, when the rewrite switch 4 is turned on and off by the rewrite gate linen 31, 1-bit data stored in the input capacitance of the inverter 3 composed of the pMOS driver 27 and the nMOS driver 26 is transferred to and stored in the gate capacitance of the luminescence drive switch 96 and the input capacitance of the first inverter stage. It should be noted that, as the number of the inverters on the data loop is even (4) in this embodiment, the polarity of this 1-bit data is not inverted and its value "L" or "H" is not changed even if the 1-bit data is input again to the input capacitance of the first inverter stage. This is because, since this embodiment uses luminescence devices 97 for display, it is not required to perform such AC drive as used in the embodiment 3.

When 1-bit data is input to the gate, the luminescence drive switch 96 turns the switch on and off in response to the value of the data, "L" or "H". If the switch is OFF, no current flows into the luminescence device 97, and thus there is no light emitted, but if a designated amount of current flows into the luminescence device 97, the device emits light. In order to optimize the luminance of the luminescence device 97, there are several alternative methods including an optimization of the structure of the luminescence device 97 itself, an adjustment of voltages on the electric power lines 98 and 99 which are separated from the 5V electric power line 28 and the 10V electric power line 29, respectively, and formation of a designated resistance with poly-Si and the like between the luminescence drive switch 96 and the low voltage electric power line 98. Those three methods provide advantages in that the structure of the pixel can become simplified, an fine adjustment of the applied voltage can be available after installation, and a high-voltage source can be embedded inside the pixel without modifying the manufacturing process, respectively.

Though an Organic Light Emitting Diode (OLED) is used for the luminescence device 97 in this embodiment, it is possible to use another two-terminal luminescence device, such as an Inorganic Light Emitting Diode, Electro Luminescence Device and so on. Though the voltage required to emit lights depends on the individual luminescence devices, this voltage difference can be controlled by varying the applied voltage on the low voltage electric power line 98 and the high voltage electric power line 99 for the individual 5V power line 28 and 10V power line 29, respectively.

This embodiment provides an advantage in that, by forming a luminescence device 97 inside the pixel, images can be displayed with self-luminescence devices in low electric power consumption without using the signal line 12, even with additional lights.

This embodiment also has the same architecture as the embodiment 1 so that an 8-level (2 to the power of 3) gray scale image display can be established by altering the display periods for three sets of single-bit data so as to be twice as long as one another, which will not be described again.

Though this embodiment assumes that 3-bit image data is used for display, the structure in this embodiment can be applied to another bit length for the image data. In case of applying this structure to a bit length other than 3-bit image data, it is required to add or remove appropriately an inverter circuit for adjusting the inversion of data or to use an amplifier which does not cause data inversion in order to invert the data after a single data loop.

(Embodiment 7)

Figure 26:
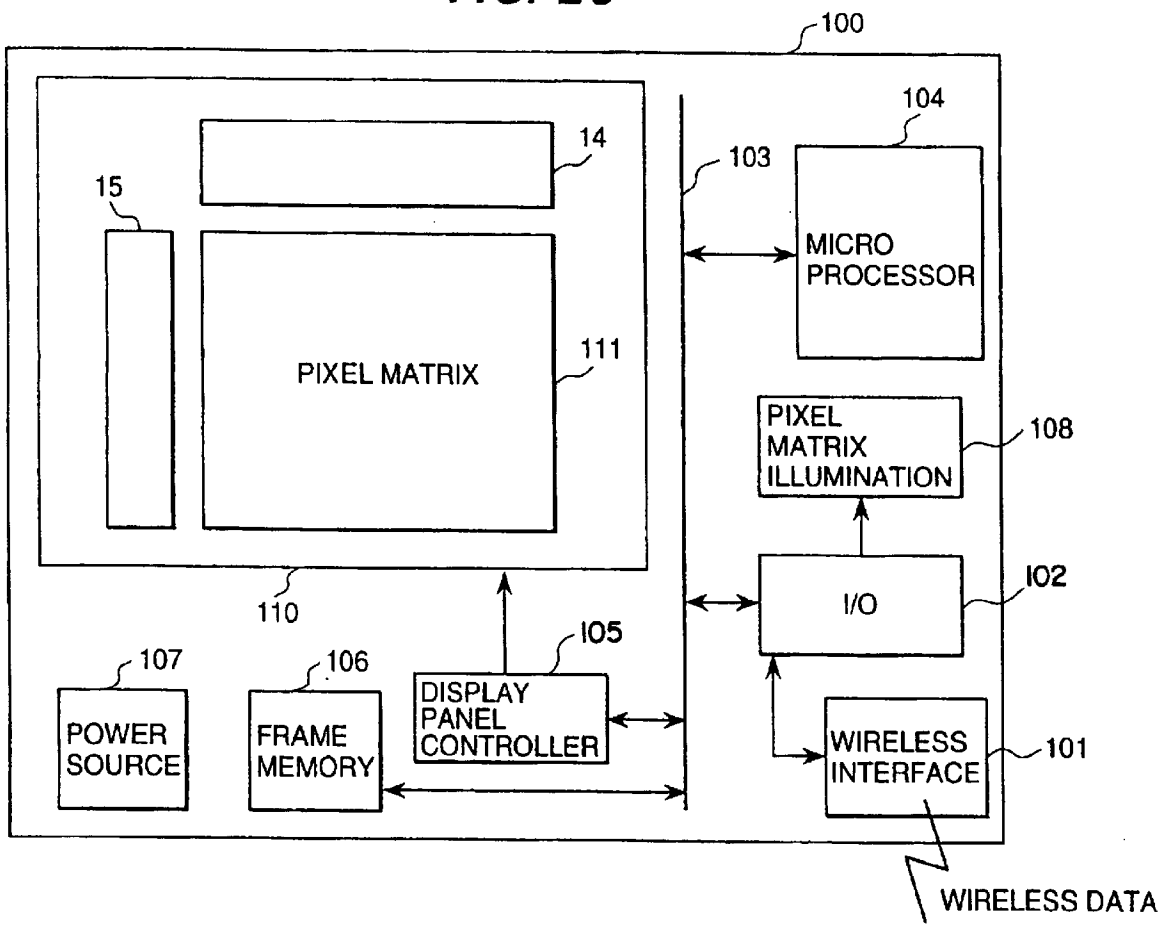
FIG. 26 is a block diagram of the image display terminal in the embodiment 7.
Figure 27:
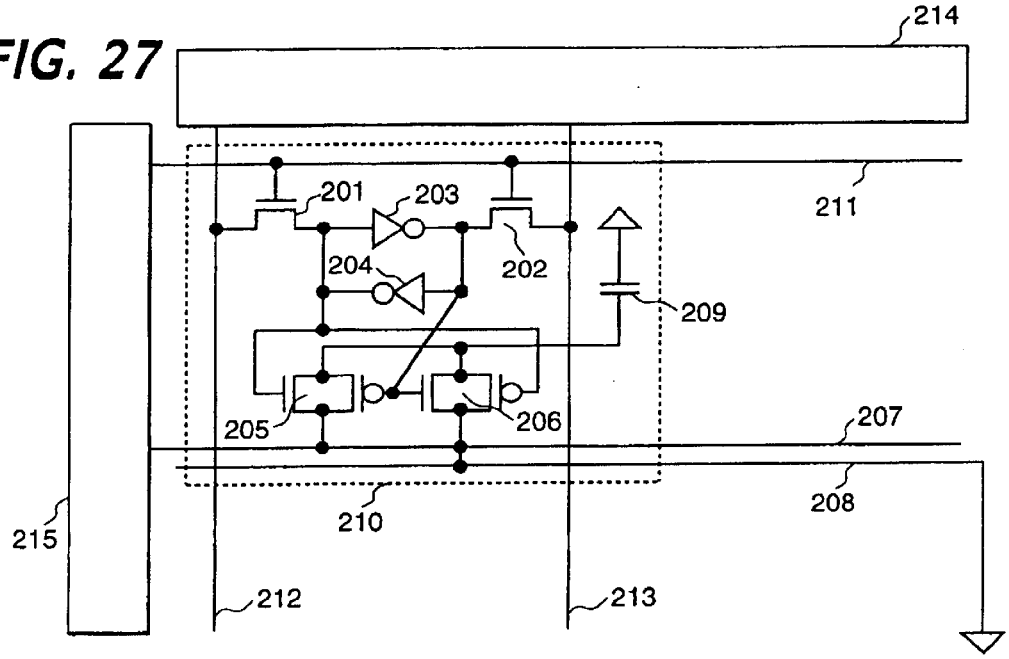
FIG. 27 is a diagram of a known TFT liquid crystal display panel.

By referring to FIG. 26, an embodiment 7 of the present invention will be described. FIG. 26 is a block diagram of the image display terminal (PDA: Personal Digital Assistants) of the embodiment 7.

Compressed image data in the form of wireless data coded in the format based on the BlueTooth specification are input to the wireless interface (I/F) circuit 101 from outside, and the output of the wireless I/F circuit 101 is connected through the I/O (Input/Output) circuit 102 to the data bus 103. Also connected to the data bus 103 is the microprocessor 104, the display panel controller 105, the frame memory 106 and so on. The output of the display panel controller 105 is also coupled to the reflection/transmission display poly-Si TFT liquid crystal display panel 110, and the reflection/transmission display poly-Si TFT liquid crystal display panel 110 has the pixel matrix 111, the gate line drive circuit 15, and the signal line drive circuit 14 and so on. The image display terminal 100 has an electric power source 107 and a pixel matrix backlight 108, and the pixel matrix backlight 108 is controlled by the I/O circuit 102. As the reflection/transmission display poly-Si TFT liquid crystal display panel 110 has an identical structure and function to that in the embodiment 1 described above, its internal structure and function will not be described here.

The operation of the embodiment 7 will be described. At first, the wireless I/F circuit 101 accepts the compressed image data from outside in response to an instruction, and the image data are transferred through the I/O circuit to the microprocessor 104 and the frame memory 106. The microprocessor 104, upon receiving an instruction command from the user, drives the image display terminal 100 and performs operations for decoding the compressed image data, processing signals and displaying the information. The image data to which signal processing is applied are temporarily stored in the frame memory 106.

In case the microprocessor 104 receives an instruction command requesting an information display in the "backlight display model", the image data are supplied from the frame memory 106 into the reflection/transmission display poly-Si TFT liquid crystal display panel 110 through the display panel controller 105 in response to the instruction command from the microprocessor 104, and then the pixel matrix 111 will display the image data supplied in the above manner in real time. In accordance with this operation, the display panel controller 105 outputs a designated timing pulse required to display the image synchronously. As described in connection with the embodiment 1, the reflection/transmission display poly-Si TFT liquid crystal display panel 110 uses those signals and operates to display 64 gray-scaled multi-valued data generated from 6-bit image data on the pixel matrix 111 in real time. It is possible for the I/O circuit 102 to drive the pixel matrix backlight 108 so that the pixel display terminal 100 provides a high-quality display image including motion pictures. The electric power source 107 includes a secondary battery, which supplies electric power for driving the overall image display terminal 100.

Next, in case the microprocessor 104 receives an instruction command requesting an information display in the "reflection display mode", after the designated image data are supplied from the frame memory 106 into the reflection/transmission display poly-Si TFT liquid crystal display panel 110 through the display panel controller 105 in response to an instruction command from the microprocessor 104, then the designated components including the frame memory 106 and the pixel matrix backlight 108 are turned off, and the microprocessor 104 is operated in low electric power consumption mode in order to reduce the electric power consumption in the image display terminal 100. As described in connection with the embodiment 1, the reflection/transmission display poly-Si TFT liquid crystal display panel 110 uses 3-bit image data written in the individual pixels and performs a display operation with low electric power consumption without using the signal line 12. In this case of the "reflection display mode", as the data length for the display image is 3-bit and thus is smaller in comparison with the "backlight display mode" with 6-bit 64 gray-scaled multi-valued data display, a designated amount in the data is reduced by the instruction from the microprocessor 104 in the image data transmission to the reflection/transmission display poly-Si TFT liquid crystal display panel 110. The 3-bit image data displayed by the reflection/transmission display poly-Si TFT liquid crystal display panel 110 can be rewritten arbitrarily by the instruction from the microprocessor 104.

According to this embodiment, it will be appreciated that an image display terminal 100 can be provided in which high-quality image display in the "backlight display mode" and a low electric power consumption image display in the "reflection display mode" can be provided selectively.

Though this embodiment uses the reflection/transmission display poly-Si TFT liquid crystal display panel 110 described in connection with the embodiment 1 for providing an image display, and the pixel matrix backlight 108 is selectively turned on and off for either the "backlight display mode" or the "reflection display mode", it is possible to use various display panels described with reference to the other embodiments of the present invention. Such display panels are not limited to a display panel allowing reflection display operation and transmission display operation selectively. Even in the case of a display panel only using the reflection display mode of operation, such an image display terminal as described above can be realized similarly, and even in the case of a display panel using luminescence devices, a display operation mode for high quality image display with higher electric power consumption and a display mode for image display with lower electric power consumption can be selected exclusively in a single apparatus with "high contrast mode" and "low contrast mode". Though display operations for providing multi-valued image data and 3-bit image data stored in the individual pixel are automatically switched in response to the selection of the "backlight display mode" and the "reflection display model, in this embodiment, it is possible to select those display modes arbitrarily based on another condition. For example, those display modes may be switched for displaying motion pictures or still images, or there may be a case where multi-valued data image display is not employed, but image data stored temporarily in the individual pixel are always used instead. Alternatively, it is possible to modify the bit length of the display image data arbitrarily in those cases.

According to the present invention, the reduction of the electric power consumption and the reduction of the cost in the image display apparatus can be established simultaneously. In addition, multi-bit image data can be displayed.

What is claimed is:

1. An image display apparatus comprising:

a display panel including a plurality of pixels;

a control circuit for controlling said display panel;

a signal line arranged inside said display panel to provide a display signal to said pixels;

wherein each pixel has at least one or more switches and a first capacitance for storing said display signal input through said signal line as a charge for a designated period of time; and means for rewriting said display signal stored in said first capacitance into said first capacitance without using said signal line in response to an instruction from said control circuit;

wherein each pixel has (n+1) or more plural capacitances, where "n" is an integer no less than 1, for storing an n-bit display signal as a charge for a designated period of time.

2. An image display apparatus as claimed in 1, wherein a data length of said display signal stored in said each pixel as a charge is 1-bit.

3. An image display apparatus as claimed in claim 1, wherein said first capacitance has a terminal connected to a gate of a first field effect transistor formed inside said each pixel.

4. An image display apparatus as claimed in claim 3, wherein a drain of said first field effect transistor is connected to ground.

5. An image display apparatus as claimed in claim 3, wherein one terminal of said first capacitance is connected to a gate of a second field effect transistor formed inside said pixel; and one terminal of said second field effect transistor is connected to a capacitance composed of liquid crystal.

6. An image display apparatus as claimed in claim 1, wherein said first capacitance includes capacitance composed of liquid crystal.

7. An image display apparatus as claimed in claim 6, wherein said pixel includes means for making said display signal rewritten in said first capacitance take two voltage values alternately for every rewrite operation.

8. An image display apparatus as claimed in claim 7, wherein said first capacitance is connected through a first switch formed inside said pixel to an output of an inverter circuit formed inside said pixel.

9. An image display apparatus as claimed in claim 7, wherein said first capacitance is connected through a second switch formed inside said pixel to an input of an inverter circuit formed inside said pixel.

10. An image display apparatus as claimed in claim 8, wherein said inverter circuit is configured as a CMOS (Complementary Metal Oxide Semiconductor) inverter circuit.

11. An image display apparatus as claimed in claim 1, wherein said first capacitance included inside said plural capacitances includes a capacitance composed of liquid crystal.

12. An image display apparatus as claimed in claim 11, wherein said pixel includes means for inputting sequentially an n-bit display signal as a charge into said first capacitance.

13. An image display apparatus as claimed in claim 12, wherein said pixel includes means for forming an (n+1)st n-bit display signal input sequentially as a charge into said first capacitance to be an inverted signal of the display signal.

14. An image display apparatus as claimed in claim 1, wherein said pixel has a number of amplifier circuits identical to the number of said plural capacitances.

15. An image display apparatus as claimed in claim 14, wherein said amplifier circuits are composed of inverter circuits.

16. An image display apparatus as claimed in claim 15, wherein said inverter circuits are composed of CMOS circuits.

17. An image display apparatus as claimed in claim 1, wherein each pixel has a charge transfer device (CTD).

18. An image display apparatus comprising:

a display panel including a plurality of pixels, each pixel having at least one or more switches and a first capacitance;

a control circuit for controlling said display panel;

a signal line arranged inside said display panel to provide a display signal to said pixels; and means for rewriting said display signal stored in said first capacitance into said first capacitance without using said signal line in response to an instruction from said control circuit;

wherein each pixel having at least one or more switches and said first capacitance, stores said display signal input through said signal line as a charge for a designated period of time; and wherein each pixel has a charge transfer device (CTD);

that is a Bucket Brigade Device (BBD).

19. An image display apparatus as claimed in claim 18, wherein:

said charge transfer device has plural transfer gates; and said control circuit includes means for driving individual plural transfer gate separately.

20. An image display apparatus as claimed in claim 19, wherein said plural transfer gates in each pixel are connected to another pixel commonly among said plurality of pixels.

21. An image display apparatus as claimed in claim 20, wherein said plural transfer gates in each pixel are substantially connected to another pixel among all pixels in said display panel.

22. An image display apparatus as claimed in claim 18, wherein:

said charge transfer device has plural transfer gates; and said control circuit includes means for driving individual plural transfer gates with a two-phase clock.

23. An image display apparatus as claimed in claim 22, wherein said plural transfer gates in each pixel are connected to one another commonly among plural pixels.

24. An image display apparatus as claimed in claim 23, wherein said plural transfer gates in each pixel are substantially connected to one another among all pixels in said display panel.

25. An image display apparatus as claimed in claim 18, wherein said first capacitance includes capacitance composed of liquid crystal.

26. An image display apparatus as claimed in claim 25, wherein each pixel includes means for inputting sequentially an n-bit display signal as a charge into said first capacitance.

27. An image display apparatus as claimed in claim 26, wherein said pixel includes means for forming an (n+1)st n-bit display signal input sequentially as a charge into said first capacitance to be an inverted signal of the display signal.

28. An image display apparatus as claimed in claim 25, wherein said first capacitance is input to said charge transfer device (CTD).

29. An image display apparatus as claimed in claim 18, wherein an output of said charge transfer device (CTD) has an amplifier circuit.

30. An image display apparatus as claimed in claim 29, wherein said amplifier circuit is an inverter circuit.

31. An image display apparatus as claimed in claim 30, wherein said inverter circuits are composed of CMOS circuits.

32. An image display apparatus comprising:

a display panel including a plurality of pixels, each pixel having at least one or more switches and a first capacitance;

a control circuit for controlling said display panel;

a signal line arranged inside said display panel to provide a display signal to said pixels; and means for rewriting said display signal stored in said first capacitance into said first capacitance without using said signal line in response to an instruction from said control circuit;

wherein each pixel having at least one or more switches and said first capacitance, stores said display signal input through said signal line as a charge for a designated period of time; and wherein one terminal of said first capacitance is connected to a gate of a field effect transistor with its one of current terminals connected to a luminescence device formed inside said pixel.

33. An image display apparatus as claimed in claim 32, wherein said luminescence device is an organic light emitting diode.

34. An image display apparatus comprising:

a display panel including a plurality of pixels, each pixel having at least one or more switches and a first capacitance;

a control circuit for controlling said display panel;

a signal line arranged inside said display panel to provide a display signal to said pixels; and means for rewriting said display signal stored in said first capacitance into said first capacitance without using said signal line in response to an instruction from said control circuit, wherein:

each pixel having at least one or more switches and said first capacitance, stores said display signal input through said signal line as a charge for a designated period of time;

said one or more switches each is composed of a thin-film transistor (TFT);

a channel film of said TFT is formed by poly-Si TFT; and said pixel includes a charge transfer device that is a Bucket Brigate Device (BBD).

35. An image display apparatus as claimed in claim 34, wherein the channel film of said TFT and a channel film of said BBD are formed by an identical process.

36. An image display apparatus as claimed in claim 34, wherein a gate electrode of said TFT and a gate electrode of said BBD are formed by an identical process.

37. A drive method of an image display apparatus comprising a display panel including a plurality of pixels each pixel having at least one or more switches and a first capacitance; a control circuit for controlling said display panel; and a signal line arranged inside said display panel for inputting a display signal into said pixel, said method comprising:

storing said display signal input through said signal-line in said first capacitance, as a charge for a designated period of time, and when said display signal is stored in said first capacitance, rewritting said display signal into said first capacitance without using said signal line in response to an instruction from said control circuit, wherein:

each pixel has plural capacitances and one or more amplifier circuits, plural display signals stored in said plural capacitances are input sequentially to said amplifier circuits, said first capacitance includes capacitance formed between a couple of display panel common electrodes with liquid crystal, and an output of said amplifier circuit is input through an input switch to said first capacitance with a designated time interval.

38. A drive method of an image display apparatus as claimed in claim 37, wherein:

said display signal formed by inverting a previous display signal, is rewritten into said first capacitance at every rewrite operation; and said common electrode is driven to be inverted substantially in synchronization with said rewrite operation of an inverted signal.

39. A drive method of an image display apparatus as claimed in claim 37, wherein said designated time interval with which said amplifier circuit inputs a display signal through said input switch to said first capacitance is defined so as to increase substantially twice as long as individual display signals.

40. A drive method of an image display apparatus as claimed in claim 37, wherein said common electrode is also driven to be inverted substantially in synchronization with an overall cycle of said amplifier circuit writing a display signal through said input switch to said first capacitance.

41. A drive method of an image display apparatus as claimed in claim 37, wherein a writing operation for display signals having analog voltage or multi-valued voltage levels is performed by interrupting a rewrite operation for said first capacitance in said pixel and using said signal line to said first capacitance instead.

42. A drive method of an image display apparatus comprising a display panel including a plurality of pixels each pixel having at least one or more switches and a first capacitance; a control circuit for controlling said display panel; and a signal line arranged inside said display panel for inputting a display signal into said pixel, said drive method comprising:

storing said display signal input through said signal-line in said first capacitance, as a charge for a designated period of time, and when said display signal is stored in said first capacitance, rewritting said display signal into said first capacitance without using said signal line in response to an instruction from said control circuit, wherein:

each pixel has plural capacitances and one or more amplifier circuits, plural display signals stored in said plural capacitances are input sequentially to said amplifier circuits, and an individual single bit of said display signal is written sequentially to individual pixels when writing plural display signals through said signal line to said plural capacitances.

* * * * *